US008277241B2

(12) United States Patent
Horchler et al.

(10) Patent No.: US 8,277,241 B2
(45) Date of Patent: Oct. 2, 2012

(54) HERMAPHRODITIC ELECTRICAL CONNECTOR

(75) Inventors: David C. Horchler, Millersburg, PA (US); Mark R. Gray, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/237,756

(22) Filed: Sep. 25, 2008

(65) Prior Publication Data

US 2010/0075516 A1 Mar. 25, 2010

(51) Int. Cl.
*H01R 13/502* (2006.01)

(52) U.S. Cl. ..... 439/295; 439/74

(58) Field of Classification Search ..... 439/284, 439/289, 290–293, 295, 65, 74, 660
See application file for complete search history.

(56) References Cited

U.S. PATENT DOCUMENTS

| | | | |
|---|---|---|---|
| 741,052 | A | 10/1903 | Mahon |
| 3,072,340 | A | 1/1963 | Dean |
| 3,157,448 | A | 11/1964 | Crimmins et al. |
| 3,461,258 | A | 8/1969 | Shlesinger |
| 3,482,201 | A | 12/1969 | Schneck |
| 3,663,925 | A | 5/1972 | Proctor |
| 3,827,007 | A | 7/1974 | Fairbairn et al. |
| 3,867,008 | A | 2/1975 | Gartland |
| 4,045,105 | A | 8/1977 | Lee et al. |
| 4,148,543 | A | 4/1979 | Shores |
| 4,232,924 | A | 11/1980 | Kline et al. |
| 4,482,937 | A | 11/1984 | Berg |
| 4,552,425 | A | 11/1985 | Billman |
| 4,582,386 | A | 4/1986 | Martens |
| 4,664,456 | A | 5/1987 | Blair et al. |
| 4,664,458 | A | 5/1987 | Worth |
| 4,737,118 | A | 4/1988 | Lockard |
| 4,820,182 | A | 4/1989 | Harwath |
| 5,030,121 | A | 7/1991 | Noorily |
| 5,035,639 | A | 7/1991 | Kilpatrick |
| 5,055,054 | A | 10/1991 | Doutrich |
| 5,098,311 | A | 3/1992 | Roath et al. |
| 5,127,839 | A | 7/1992 | Korsunsky et al. |
| 5,161,985 | A | 11/1992 | Ramsey |
| 5,167,528 | A | 12/1992 | Nishiyama et al. |
| 5,181,855 | A | 1/1993 | Mosquera et al. |
| 5,334,029 | A | 8/1994 | Akkapeddi et al. |
| 5,382,168 | A | 1/1995 | Azuma et al. |
| 5,387,139 | A | 2/1995 | McKee et al. |
| 5,395,250 | A | 3/1995 | Englert et al. |

(Continued)

FOREIGN PATENT DOCUMENTS

| | | |
|---|---|---|
| GB | 2299465 | 10/1996 |

(Continued)

OTHER PUBLICATIONS

MicroStac 0,8 mm Mezzanine Steckverbindersystem, www.erni.com, Katalog D 074520, Feb. 2008, 24 pages.

(Continued)

*Primary Examiner* — Felix O Figueroa
(74) *Attorney, Agent, or Firm* — Woodcock Washburn LLP

(57) ABSTRACT

The disclosure describes an electrical connector assembly having first and second electrical connectors configured for mating. Each connector includes a housing that supports a plurality of electrical contacts. The contacts are arranged in first and second rows, and define a first terminal end extending from the housing and configured to connect with an electrical component, and a second hermaphroditic terminal end extending from the housing.

19 Claims, 25 Drawing Sheets

U.S. PATENT DOCUMENTS 5,498,167 A 3/1996 Seto et al.
5,520,545 A 5/1996 Sipe
5,527,189 A 6/1996 Middlehurst et al.
5,562,442 A 10/1996 Wilhelm
5,573,409 A 11/1996 Shiley et al.
5,618,191 A 4/1997 Chikano et al.
5,664,968 A 9/1997 Mickievicz
5,697,799 A 12/1997 Consoli et al.
5,730,606 A 3/1998 Sinclair
5,782,656 A 7/1998 Zell et al.
5,795,191 A 8/1998 Preputnick et al.
5,871,362 A 2/1999 Campbell et al.
5,893,761 A 4/1999 Longueville
5,902,136 A 5/1999 Lemke et al.
5,904,581 A 5/1999 Pope et al.
5,904,594 A 5/1999 Longueville et al.
RE36,217 E 6/1999 Petersen
5,971,800 A 10/1999 Azuma et al.
5,984,690 A 11/1999 Riechelmann et al.
5,992,953 A 11/1999 Rabinovitz
6,022,227 A 2/2000 Huang
6,024,584 A 2/2000 Lemke et al.
6,074,230 A 6/2000 Comerci et al.
6,079,991 A 6/2000 Lemke et al.
6,097,609 A 8/2000 Kabadi
6,129,592 A 10/2000 Mickievicz et al.
6,146,208 A 11/2000 Pennell
6,152,747 A 11/2000 McNamara
6,154,742 A 11/2000 Herriot
6,164,983 A 12/2000 Lemke et al.
6,183,301 B1 2/2001 Paagman
6,193,537 B1 2/2001 Harper, Jr. et al.
6,193,557 B1 2/2001 Luvini et al.
6,241,535 B1 6/2001 Lemke et al.
6,379,170 B1 4/2002 Czeschka et al.
6,390,826 B1 5/2002 Affolter et al.
6,409,543 B1 6/2002 Astbury et al.
6,443,750 B1 9/2002 Lemke et al.
6,475,010 B1 11/2002 Yu
6,494,734 B1 12/2002 Shuey
6,517,360 B1 2/2003 Cohen
6,537,087 B2 3/2003 McNamara et al.
6,540,529 B1 4/2003 Yu
6,641,410 B2 11/2003 Marvin et al.
6,699,048 B2 3/2004 Johnson et al.
6,702,590 B2 3/2004 Zaderej et al.
6,712,626 B2 3/2004 Harper, Jr. et al.
6,835,072 B2 12/2004 Simons et al.
6,851,954 B2 2/2005 Ashman et al.
6,860,741 B2 3/2005 Ashman et al.
6,869,292 B2 3/2005 Johnescu et al.
6,893,300 B2 5/2005 Zhou et al.
6,902,411 B2 6/2005 Kubo
6,918,776 B2 7/2005 Spink, Jr.
6,939,173 B1 9/2005 Elco et al.
6,951,466 B2 10/2005 Sandoval et al.
7,018,239 B2 3/2006 Zaderej et al.
7,153,170 B1 12/2006 Fabian
7,182,608 B2 2/2007 Soh et al.
7,214,104 B2 5/2007 Minich et al.
7,220,141 B2 5/2007 Daily et al.
7,229,318 B2 6/2007 Winings
7,309,239 B2 12/2007 Shuey
7,407,387 B2 8/2008 Johnescu
7,452,249 B2 11/2008 Daily et al.
7,553,182 B2 6/2009 Buck
7,635,278 B2 12/2009 Shuey et al.
2002/0127903 A1 9/2002 Billman et al.
2004/0157477 A1 8/2004 Johnson et al.
2005/0079763 A1 4/2005 Lemke et al.
2005/0101188 A1 5/2005 Benham et al.
2005/0277315 A1 12/2005 Mongold et al.
2006/0051987 A1 3/2006 Goodman et al.
2006/0148283 A1 7/2006 Minich et al.
2006/0172570 A1 8/2006 Minich et al.
2007/0004287 A1 1/2007 Marshall

FOREIGN PATENT DOCUMENTS

GB 2312566 10/1997
GB 2345807 7/2000
JP 56-51269 A 5/1981
JP 1276575 11/1989
JP 2177277 7/1990
JP 2297509 12/1990
JP 51-43434 A 6/1993
JP 2003-317861 11/2003
WO WO 00/31832 6/2000
WO WO 2007/076901 7/2007

OTHER PUBLICATIONS

U.S. Appl. No. 10/779,172, filed Feb. 11, 2004, Johnescu.
U.S. Appl. No. 10/940,329, filed Sep. 14, 2004, Johnescu.

HERMAPHRODITIC ELECTRICAL CONNECTOR

BACKGROUND

The present invention generally relates to electrical connectors, and in particular relates to electrical connectors having gender-neutral electrical contacts Electrical connector assemblies include electrical connectors that can attach to provide signal connections between electronic devices. In particular, each electrical connector includes electrical signal contacts that are provided as male that receive complementary female contacts, or female contacts that are inserted into complementary male contacts. The gender-specific contacts can require specialized connectors that are configured to connect with a mating connector. Furthermore, the connectors need to be precisely aligned for connection.

SUMMARY

In accordance with one aspect, an electrical connector assembly is provided. The electrical connector assembly includes a first and second connector configured for mating. Each connector includes a housing that defines an engagement surface. Each connector further includes a plurality of electrical contacts secured in the housing and arranged in first and second rows. The contacts define a first terminal end extending from the housing and configured to connect with an electrical component, and gender-neutral second terminals end extending from the housing. The housings of the connectors are configured to engage each other such that the second terminal ends of the each connector mate, and the engagement surfaces of each connector engage at a location between the rows of contacts so as to restrict relative movement of the housings.

DETAILED DESCRIPTION OF ILLUSTRATIVE EMBODIMENTS

Figure 1:
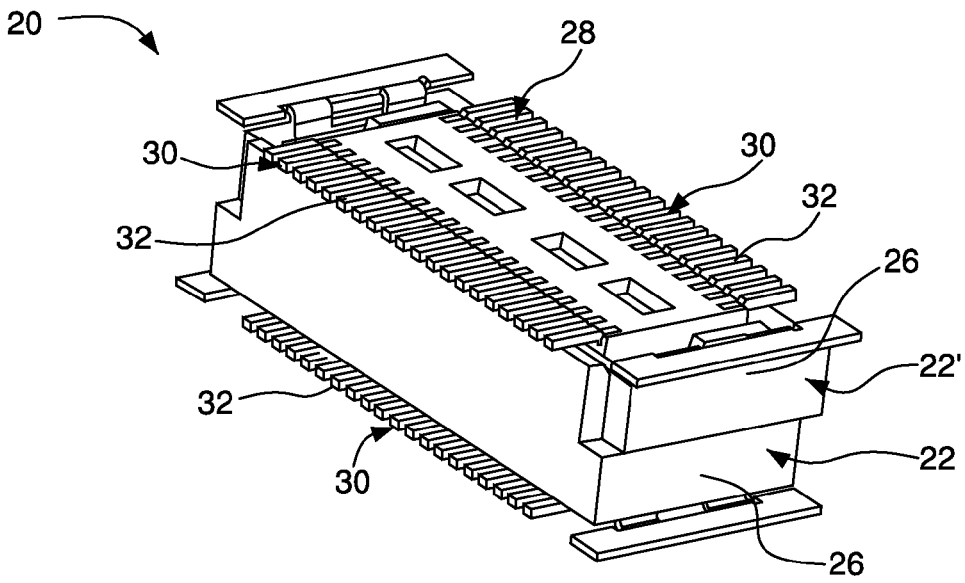
FIG. 1 is a perspective view of an electrical connector assembly including a pair attached and fully seated electrical connectors constructed in accordance with one example embodiment of the present invention.
Figure 2:
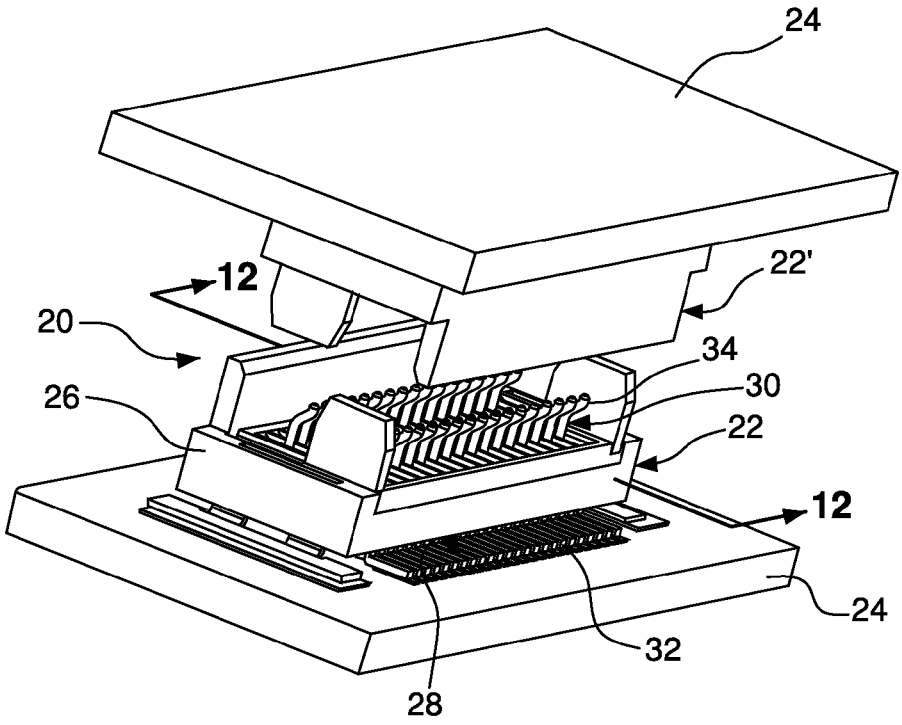
FIG. 2 is an assembly view of the electrical connectors illustrated in FIG. 1, each attached to an electrical component.

Referring to FIGS. 1-2, an electrical connector assembly 20 includes a pair of electrical connectors 22 and 22' that are each configured for attachment to each other at one end, and an electrical component 24 at another end. The connector assembly 20 is thus configured to establish an electrical connection between the pair of electrical components 24, which can be in the form of printed circuit boards as illustrated. It should be appreciated, however, that the electrical connector 20 could alternatively be configured to connect other electrical components as desired, such as cables, terminals, and the like. Because each connector 22 and 22' is similarly or identically constructed and interchangeable with the each other, only connector 22 is described in detail below. It should therefore be appreciated that the description of connector 22 equally applies to the description of the corresponding connector 22' unless otherwise specified.

The connector 22 includes a connector housing 26 that supports an electrical contact assembly 28. The contact assembly 28 of each connector 22 includes a plurality of electrically conductive contacts 30, each having a first terminal 32 configured for attachment to the complementary electrical component 24, and a second terminal 34 configured for attachment to the second terminal of the complementary or mating electrical connector 22 of the electrical connector assembly 20. As will be appreciated from the description below, the second terminals 34 of the contacts 30 are gender-neutral, or hermaphroditic, thus allowing for general interchangeability between connectors of a connector assembly.

Figure 3:
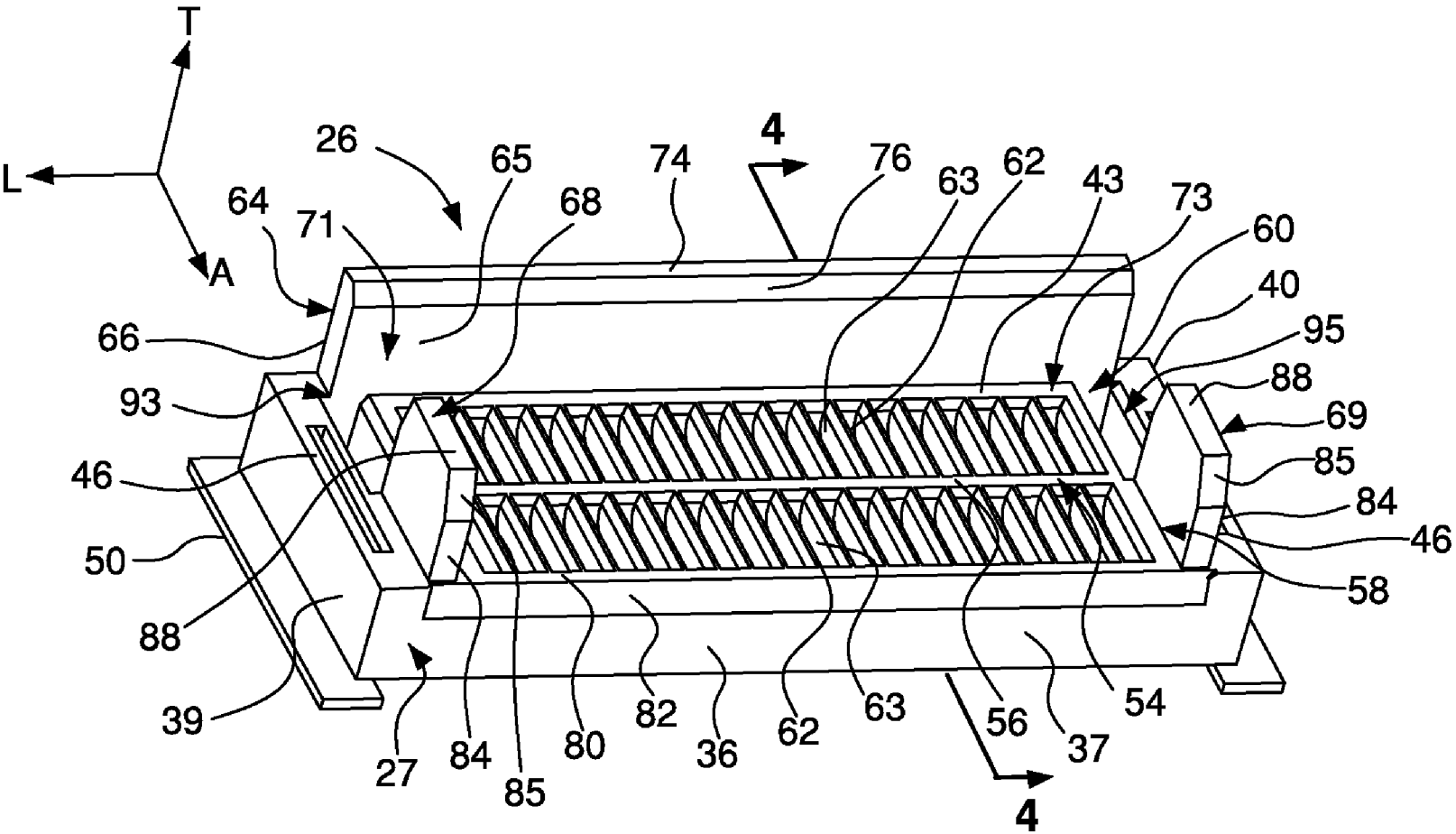
FIG. 3 is a perspective view of a housing of one of the connectors illustrated in FIG. 1.
Figure 4:
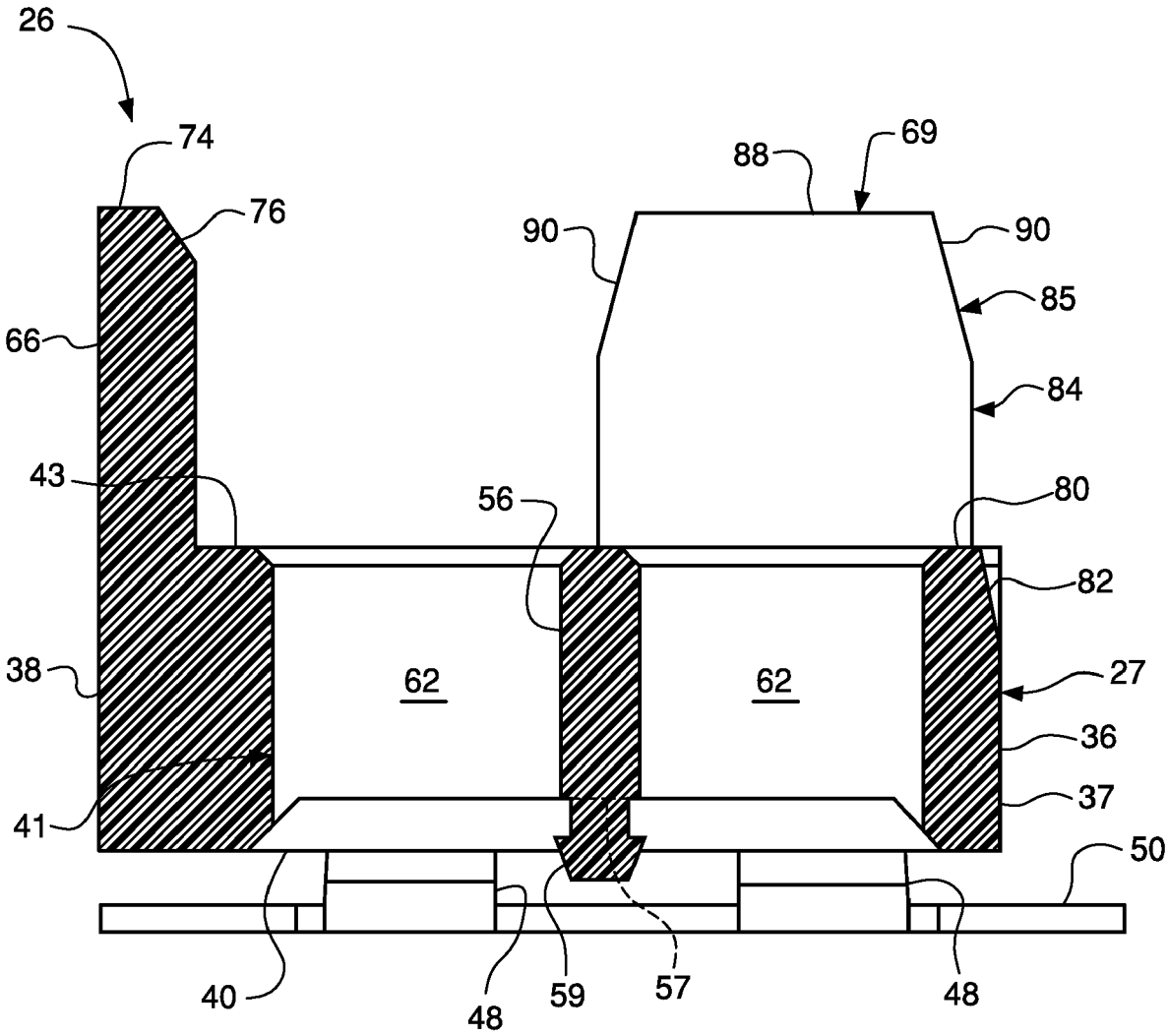
FIG. 4 is a sectional side elevation view of the housing illustrated in FIG. 3, taken along line 4-4.

Referring now to FIGS. 3 and 4, the connector housing 26 can be formed from a dielectric material, such as plastic, for example. The housing 26 is illustrated as being generally rectangular in shape, and can extend horizontally along a longitudinal direction "L" and lateral direction "A", and vertically along a transverse direction "T". The housing is elongate in the longitudinal direction L. Unless otherwise specified herein, the terms "lateral," "longitudinal," and "transverse" as used to describe the orthogonal directional components of the connector housing 26 are likewise used to describe the directional components of the remainder of the connector assembly 20. The terms "inboard" and "inner," and "outboard" and "outer" with respect to a specified directional component are used herein with respect to a given apparatus to refer to directions along the directional component toward and away from the center apparatus, respectively.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the electrical components 24. Accordingly, the terms "vertical" and "horizontal" are used to describe the connector assembly 20 as illustrated merely for the purposes of clarity and convenience, it being appreciated that these orientations may change during use.

Each connector housing 26 defines a base 27 that includes a pair of opposing longitudinally elongate side walls 36 and 38 connected at their longitudinally outer ends by first and second opposing laterally elongate end walls 39 and 40, respectively. The side walls 36 and 38 and end walls 39 and 40 define a void 41 that can retain at least a portion of the electrical contact assembly 28.

Each end wall 39 and 40 defines a slot 46 that extends vertically into the bottom end of the end wall 40. As illustrated, each slot 46 can extend vertically through the end wall 40 for manufacturing purposes. Each slot 46 can receive the upper end of one or more mounting legs 48 that, in turn, support a laterally elongate horizontal mounting plate 50 which can be made from any suitable material. A pair of mounting legs 48 is illustrated as being attached to each end wall 39 and 40 within the slot 46 using any known fastener or attachment mechanism. Each mounting leg 48 can extend vertically downward from the slot 46, below the base 27 of the housing 26, and longitudinally outboard from the base 27. Each pair of mounting legs 48 can be connected at its lower end to the mounting plate 50, either integrally or via any suitable mechanical fastener. The mounting plate 50 can, in turn, be attached to the electrical component 24 via solder 52 (see FIG. 11) or any alternative suitable fastening apparatus known to one having ordinary skill in the art. Attaching the mounting plates 50 to the electrical component 24 can provide support and add strength to the connection of the electrical contacts 30 to the electrical component 24.

With continuing reference to FIGS. 3 and 4, the housing 26 defines a contact support assembly 54 that is configured to receive the electrical contact assembly 28, and an engagement assembly 64 that is configured to mate with the engagement assembly of the corresponding connector 22' when the connectors 22 and 22' are attached.

The contact support assembly 54 can include a longitudinally elongate spine 56 extending between the end walls 39 and 40 at a location substantially laterally midway between the side walls 36 and 38. The spine 56 can be a vertical wall having an upper end that is generally coplanar with the upper ends of the end walls 40 so that the upper ends of the end walls 40 of the connectors 22 and 22' engage and can seat against each other when the connectors 22 and 22' are attached. The upper surface the spine 56 can extend substantially horizontally as illustrated, or be angled with respect to the horizontal.

The spine 56 can define a lower end 57 and a plurality of compressible barbs 59 extending vertically down from the lower end 57 that are configured for attachment with the electrical contact assembly 28. In one embodiment, a plurality of longitudinally elongate barbed ends 59 can be spaced longitudinally from each other along the lower end 57 of the spine 56. Alternatively, the barb 59 can extend longitudinally along an entirety, or substantial entirety of the lower end 57. The barbed end or ends 59 can terminate at a location above the mounting plate 50 so as to avoid interference with the attached electrical component 24.

The spine 56 divides the void 41 into first and second laterally spaced rows 58 and 60 that are configured to receive corresponding rows of the electrical contacts 30. The first row 58 is disposed adjacent the side wall 36, while the second row 60 is disposed adjacent the side wall 38. Each row 58 and 60 defines a first longitudinal end 71 disposed proximal the first end wall 39, and a second opposing longitudinal end 73 disposed proximal the second end wall 40.

The contact support assembly 54 can further include a plurality of dividers 62 disposed in each row 58 and 60. Each divider 62 can be a vertical wall that extends laterally between the spine 56 and the corresponding side wall 36 or 38. The dividers 62 can be longitudinally spaced from each other to divide the rows 58 and 60 into a plurality of contact receptacles 63 that are each disposed between adjacent dividers 62. Each receptacle 63 can define a longitudinal thickness greater than that of the electrical contacts 30, and are thus configured to receive one of the electrical contacts 30. Because the row 58 of connector 22 mates with row 60 of the corresponding connector 22', and row 60 of connector 22 mates with row 58 of connector 22' when the connectors are attached, the receptacles 63 of rows 58 and 60 are at least partially longitudinally aligned so that the second terminals 34 of the corresponding electrical contacts 30 of the connectors 22 and 22' can engage when the connectors are attached.

The upper ends of the dividers 62 can be substantially co-planar with the upper end of the spine 56 such that the dividers 62 of the connectors 22 and 22' can seat against each other when the connectors are attached. Alternatively, one or more of the dividers 62 can define an upper surface disposed above the spine 56, and the complementary dividers 62 of the corresponding connector 22' that are aligned with the dividers 62 have a reduced height so that the engagement of the dividers 62 of connectors 22 and 22' does not interfere with the seating engagement of the two connectors. The upper ends of the dividers 62 can extend substantially horizontal as illustrated, or can be angled with respect to the horizontal While the upper ends of the dividers 62, spine 56, and end walls 39 and 40 of the connectors 22 and 22' are described and illustrated as being substantially co-planar and can seat against each other when the connectors 22 and 22' are attached, it should be appreciated that one or more of the dividers 62, spine 56, and end walls 39 and 40 can have a height less than the other components such that one of the components provides a seating surface when the two connectors 22 and 22' are attached.

With continuing reference to FIGS. 3 and 4, the engagement assembly 64 can include the side walls 36 and 38, an engagement wall 66, a pair of engagement grooves 70 and 72, and a corresponding pair of engagement tabs 68 and 69 seated in the engagement grooves.

The engagement wall 66 can extend vertically up from the side wall 38, and can have a lateral thickness that is less than the lateral thickness of side wall 38. The laterally inner edges of the engagement wall 66 and the side wall 38 can be laterally offset such that the upper end of the side wall 38 defines a seat 43 that projects laterally inward from the engagement wall 66. The engagement wall 66 extends up from the side wall 38 a distance that is substantially equal to the height of side wall 36 such that the side wall 36 of the opposing connector 22' can nest adjacent the engagement wall 66 when the connectors 22 and 22' are attached. The engagement wall 66 can be attached to the side wall 38 via any known fastener, or can alternatively be integral with the side wall 38. The engagement wall 66 can terminate at a horizontal upper surface 74 and a beveled surface 76 that extends laterally inboard and down from the laterally inner end of the upper surface 74. The engagement wall 66 can define a laterally inner surface 65 that extends between the seat 43 and the beveled surface 76.

The side wall 36 can likewise terminate at a substantially horizontal upper surface 80 and a beveled surface 82 extending laterally outboard and down from the laterally outer end of the upper surface 77. The beveled surface 82 of the side wall 36 of connector 22 is configured to be in alignment with the beveled surface 76 of the engagement wall 66 of the connector 22' when the connectors 22 and 22' are aligned for attachment. The side wall 36 defines a laterally outer surface 37 that extends down from the beveled surface 82.

Figure 5A:
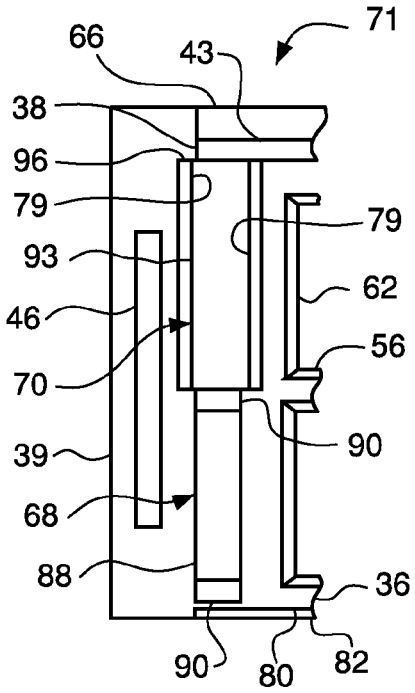
FIG. 5A is a top plan view of a first longitudinal end of the housing illustrated in FIG. 3.
Figure 5B:
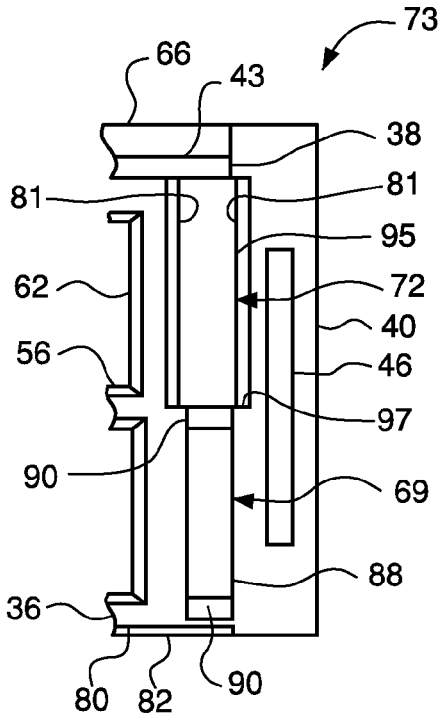
FIG. 5B is a top plan view of a second longitudinal end of the housing illustrated in FIG. 3.

As described above, the engagement assembly 64 further includes first and second engagement tabs 68 and 69 that are disposed in corresponding first and second engagement grooves 70 and 72, respectively, that are disposed at the first and second end 71 and 73, respectively, of the housing 26. Referring also to FIGS. 5A and 5B, each groove 70 and 72 can be laterally elongate and extend between opposing side walls 36 and 38. The first groove 70 can further extend substantially vertically between the longitudinally inner surface of the first end wall 39, and the longitudinally outer dividers 62 of the first end 71 of rows 58 and 60 along with the first longitudinal end of the spine 56. The second groove 72 can likewise extend substantially vertically between the longitudinally inner surface of the second end wall 40, and the outer dividers 62 of the second end 73 of rows 58 and 60 along with the second longitudinal end of the spine 56.

The first engagement tab 68 extends longitudinally between the first end wall 39 and longitudinally outer divider 62 of the first end 71 of row 58, and extends laterally between the side wall 36 and the spine 56. The first engagement tab 68 can be attached to the housing 26 within the groove 70 using any known mechanical fastener, or can alternatively be integrally formed with the housing 26. The first groove 70 is further defined by a notch 96 that can extend into the longitudinally inner vertical surface of the end wall 40. The notch 96 can extend laterally between the side wall 38 and the engagement tab 68, and extends longitudinally a distance into the end wall 39 a distance less than the thickness of end wall 39.

The groove 70 therefore further includes a first receptacle 93 that is defined by the notch 96, the side wall 38, the longitudinally outermost divider 62 at the first end 71 of row 60, and the engagement tab 68. The receptacle 93 extends laterally a distance substantially equal to the cumulative lateral distance defined by the engagement tab 68 and side wall 36. The longitudinally outer divider 62 of the first end of row 60 has a longitudinal thickness greater than the longitudinally outer divider 62 of row 58. Accordingly, the receptacle 93 can be longitudinally offset in a direction toward the first end 71 with respect to the engagement tab 68. The receptacle 93 can thus receive the engagement tab 68 and side wall 36 of connector 22' when the connectors 22 and 22' are attached. The receptacle 93 can define beveled longitudinal outer walls 79 that can assist in aligning and inserting engagement tab 68 into the receptacle 93.

The second groove 72, extends longitudinally between the second end wall 40 and longitudinally outer divider 62 of the second end 73 of row 58, and extends laterally between the side wall 36 and the spine 56. The second groove 72 can be further defined by a notch 97 that extends into the longitudinally inner vertical surface of the end wall 40. The notch 97 can extend laterally between the side wall 36 and the spine 56. The second engagement tab 69 extends longitudinally between the second end wall 40 and longitudinally outer divider 62 of the second end 73 of row 58, and extends laterally between the side wall 36 and the spine 56. The second engagement tab 69 can be attached to the housing 26 within the groove 72 using any known mechanical fastener, or can alternatively be integrally formed with the housing 26.

The second groove 72 defines a second receptacle 95 that is defined by the end wall 40, side wall 38, the longitudinally outermost divider 62 at the second end 73 of row 60, and the engagement tab 69. The receptacle 95 extends laterally a distance substantially equal to the cumulative lateral distance defined by the engagement tab 69 and side wall 36. The longitudinally outer divider 62 of the second end 73 of row 58 has a longitudinal thickness greater than the longitudinally outer divider 62 of the second end 73 of row 60. Accordingly, the receptacle 95 can be longitudinally offset in a direction toward the first end 71 with respect to the engagement tab 69. The receptacle 95 can thus receive the engagement tab 69 and side wall 36 of connector 22' when the connectors 22 and 22' are attached. The receptacle 93 can define beveled longitudinal outer walls 81 that can assist in aligning and inserting engagement tab 68 into the receptacle 93.

The first and second engagement tabs 68 and 69 can each have a height greater than that of the side wall 36 and end walls 49 and 40, respectively. Each engagement tab 68 and 69 can include a substantially vertical bottom end 84 that extends up from the corresponding groove 70 and 72, respectively, and an upper end 85 extending up from the bottom end 84. The upper end 86 terminates at a substantially horizontal upper surface 88 and a pair of opposing beveled surfaces 90 extending laterally out and down from the upper surface 88. The beveled surfaces 90 can extend down the upper end 86 terminate at the bottom end 84. The inner beveled surfaces 90 of tabs 68 and 69 of connector 22 are configured to engage the inner beveled surfaces 90 of tabs 68 and 69, respectively, of connector 22' when the two connectors 22 and 22' are attached.

Figure 6:
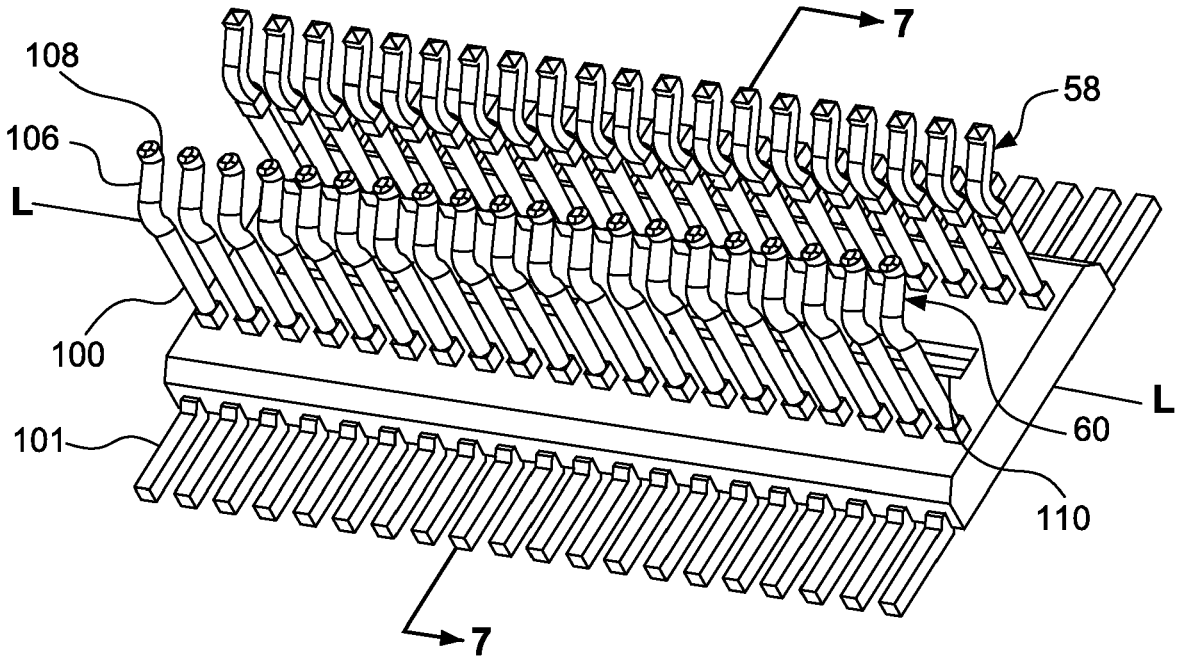
FIG. 6 is a perspective view of an electrical contact assembly of one of the connectors illustrated in FIG. 1.
Figure 7:
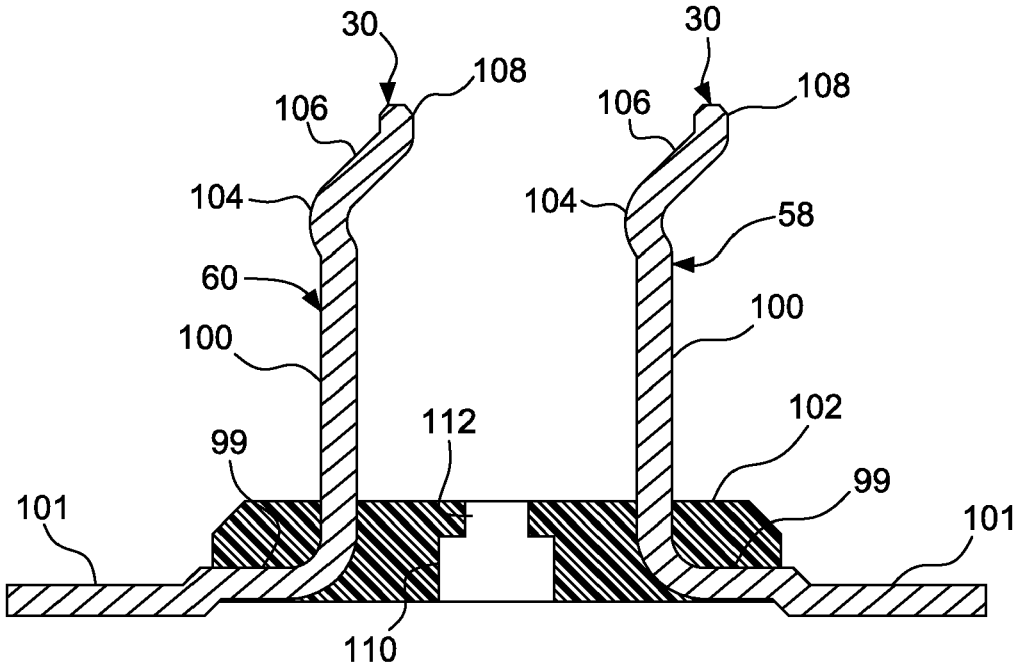
FIG. 7 is a sectional side elevation view of the electrical contact assembly illustrated in FIG. 6, taken along line 7-7.

Referring now to FIGS. 6-7, the contact assembly 28 includes a first row 58 of electrical contacts, and a second row 60 of electrical contacts 30 corresponding to the first and second rows 58 and 60 of the connector housing 26, respectively. The contacts 30 can define a round, for instance circular, cross section as illustrated, or can alternatively have a cross section that defines a square, rectangular, or any alternative suitable geometry. The contacts 30 can be made from any suitable electrically conductive material. Each electrical contact 30 of a given row is similarly constructed, and extends parallel to the other contacts 30 of that row. Likewise, the contacts of both rows 58 and 60 are similarly constructed, and extend parallel to each other. Accordingly, one exemplary contact 30 will be described, it being appreciated that the description of the exemplary contact 30 can apply to all contacts 30.

The contact 30 can include a vertical stem 100 and an upper base portion 99 extending laterally outward from the lower end of the stem 100. A lower base portion 101 that is vertically offset from the upper base can connect to the laterally outer end of the upper base portion 99, and extend laterally outward from the upper base portion 99. The upper end of the stem 100 can be connected to a jog 104 that juts out in a direction laterally offset with respect to the stem 100. When the electrical contact assembly 28 is installed in the housing 26, the jog juts out in a direction toward the engagement wall 66. The jogs 104 of both rows 58 and 60 of contacts 30 are offset in the same lateral direction. The upper end of the jogs 104 are connected to an angled cam portion 106 that extends up and out in a lateral direction opposite that of the jog 104, and terminates at a vertical end 108 that extends up from the cam portion 106. The vertical end 108 can be laterally offset with respect to stem 100 in a direction opposite the engagement wall 66 when the electrical contact assembly 28 is installed in the housing. In accordance with certain aspects of the present invention, the angled cam portion 106 can extend at an angle within a range of 25 and 60 degrees, including 45 degrees, with respect to the vertical stem 100.

It should be appreciated that unless otherwise specified, the electrical contacts 30 could alternatively assume any desirable geometric orientation that enables attachment to the electrical component 24 and also to the complementary contacts 30 of the other connector of the connector assembly 20 in a gender-neutral manner. It should be further appreciated that the number of electrically conductive contacts 30 of the contact assembly 28 can vary depending on the desired application.

In one aspect of the present invention, the contacts 30 can define a pitch within a range whose lower end can be defined by approximately 0.2 mm and whose upper end can be defined by approximately 0.5 mm. The pitch can be measured as the longitudinal distance between the center of the upper ends of adjacent contacts 30 that are disposed in a given row.

The contact assembly 28 can further include a contact retention plate 102 that receives the stem 100 of each contact 30. The retention plate can extend substantially horizontally, and be longitudinally elongate commensurate with the shape of the housing 26. The retention plate 102 can be formed from a resin or other suitable dielectric material that can be injection molded around the lower ends of the stem 100, and around the upper base portion 99 of each contact 30. The stems 100 thus can extend up from the retention plate 102 while the base 98 can be disposed below the retention plate 102.

A plurality of apertures 110 (see FIG. 9) can extend vertically through the retention plate 102, and can be sized to receive the barbs 59 of the spine 56. The apertures 110 can be spaced longitudinally along an axis L-L that substantially bisects the engagement plate 102. Each aperture 110 can further extend longitudinally along axis L-L. Alternatively, a single longitudinal elongate aperture can extend through the retention plate 102. Each aperture 110 can define an upper neck 112 having a reduced thickness compared to the remainder of the aperture 110. The apertures 110 are in alignment with the barbs 59 of the spine 56 when the electrical contact assembly 20 is attached to the connector housing 36. The thickness of the necks 112 are also reduced with respect to the thickness of the barbs 59 such that the barbs compress to fit through the necks 112. The barbs 59 then expend once they are disposed in the aperture 110 to prevent the spine 56 from being inadvertently detached from the retention plate 102.

Figure 8:
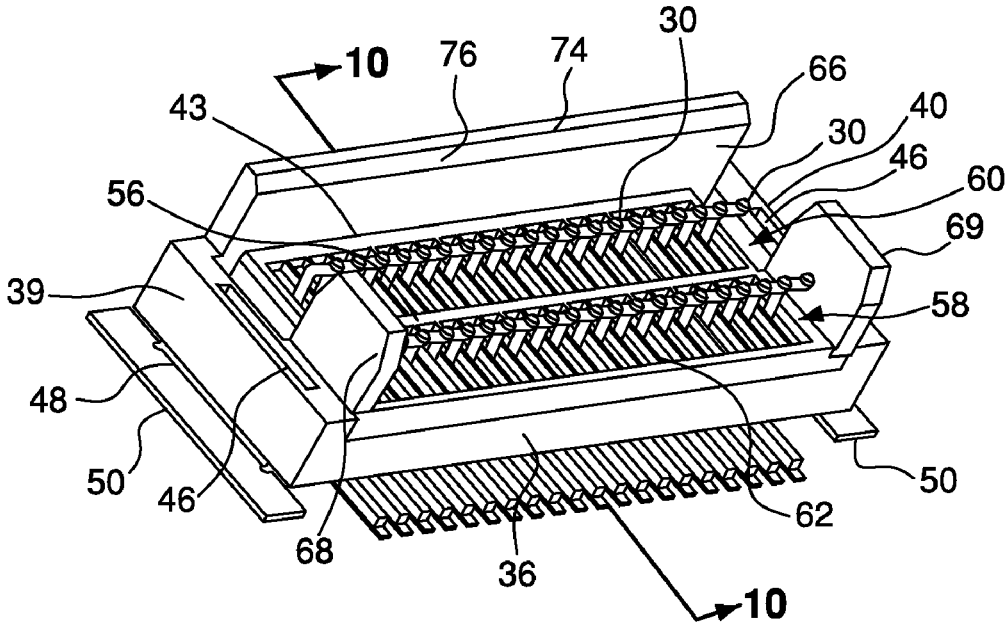
FIG. 8 is a top perspective view of one of the connectors illustrated in FIG. 1.
Figure 9:
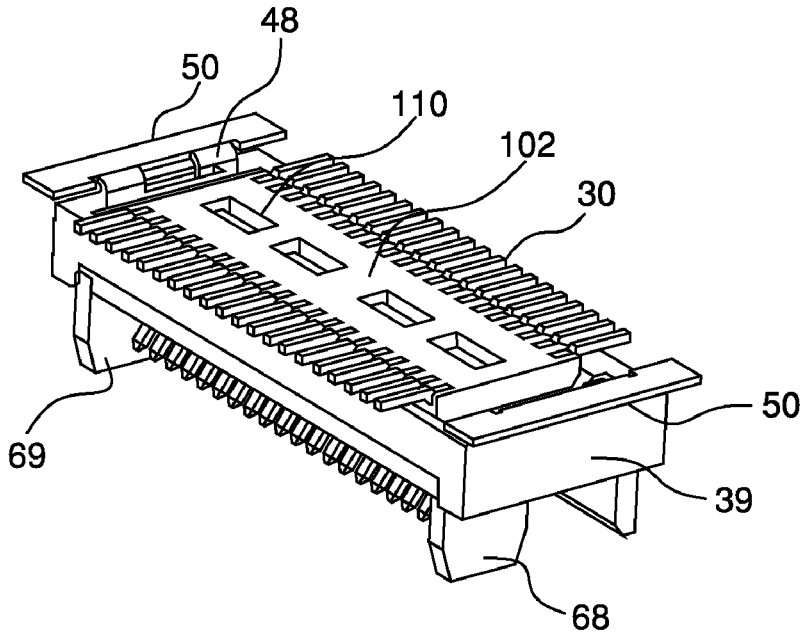
FIG. 9 is a bottom perspective view of the connector illustrated in FIG. 8.
Figure 10:
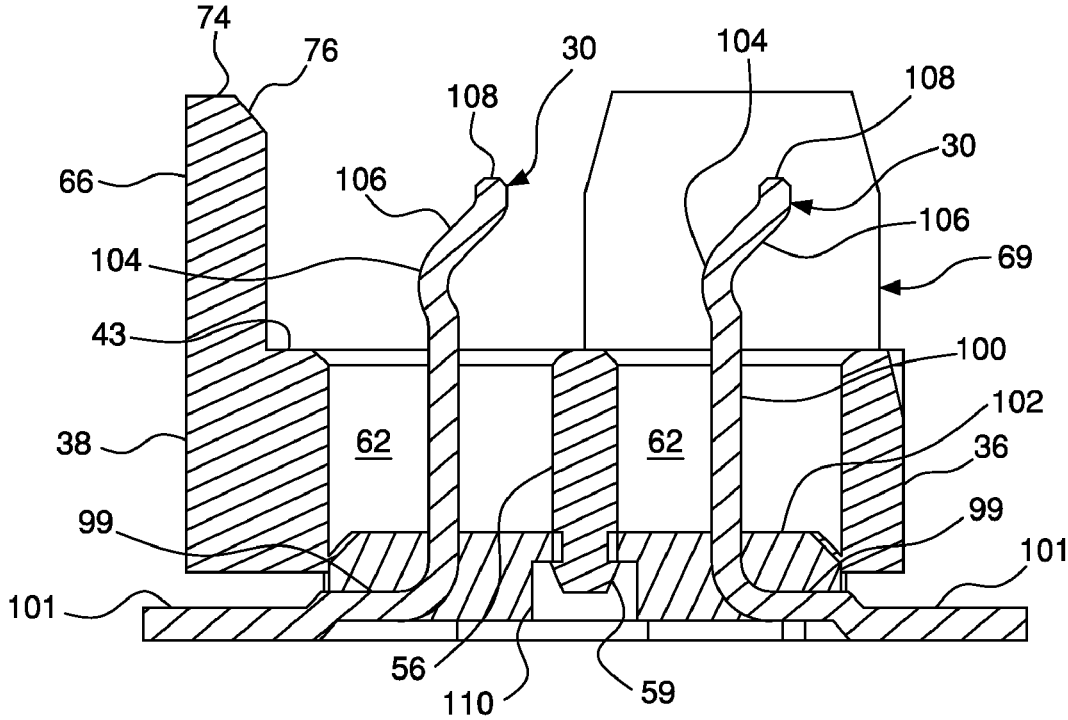
FIG. 10 is a sectional side elevation view of the connector illustrated in FIG. 7, taken along line 10-10.

The attachment of the electrical contact assembly 28 to the connector housing 26 will now be described with reference to FIGS. 8-10. In the illustrated embodiment, the retention plate 102 is generally aligned with the void 41 of the housing 26 such that the longitudinally opposing edges of the plate 102 are disposed between the end walls 39 and 40, the laterally opposing edges of the plate 102 are disposed between the side walls 36 and 38, and the vertical ends 108 of each row of contact 58 and 60 are aligned with the corresponding receptacles 63. The upper ends of the electrical contacts 30 are then inserted into the receptacles 63, and are oriented such that the angled cam portions 106 extend toward the side wall 36, though it should be appreciated that the cam portions could alternatively extend toward side wall 38, or in any other direction such that the complementary contacts 30 of connectors 22 and 22' are configured to attach to the each other. When the electrical contact assembly 28 is installed in the housing 26, the jogs 104 of the contacts are disposed above the dividers 62.

As the electrical contact assembly 28 is inserted into the housing 26, the apertures 110 are aligned with the barbed ends 59 of the divider 56 such that the barbs 59 compress as they are inserted through the neck 112 of the corresponding apertures. Each barb 59 can expand once inserted through the neck 112 and into the aperture 110 to attach the electrical contact assembly 28 to the connector housing 26. It should be appreciated that, unless otherwise specified, the electrical contact assembly 28 could alternatively be constructed in any suitable manner sufficient to attach to the housing 26 while positioning the electrical contacts 30 to attach to the electrical traces of the electrical component 24 at one end, and to complementary electrical contacts 30 of the other connector of the electrical connector assembly 20.

Figure 11:
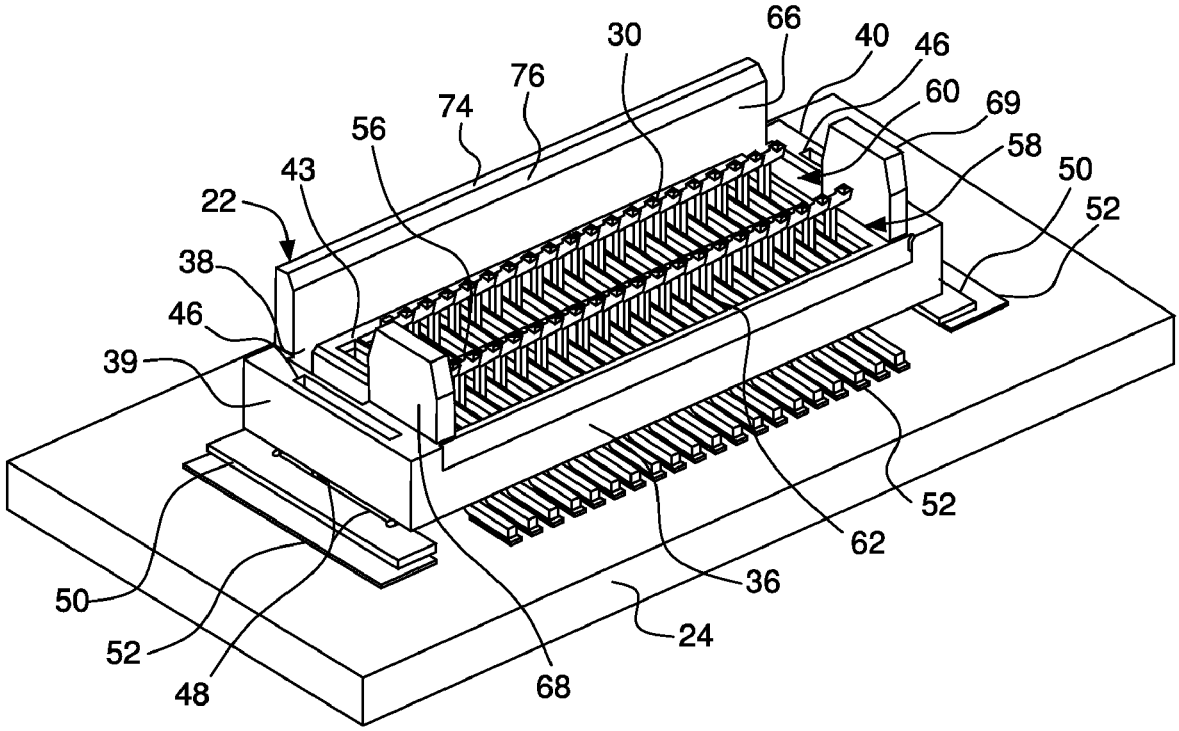
FIG. 11 is a perspective view of the connector illustrated in FIG. 7, showing the connector attached to an electrical component.

Referring now to FIG. 11, connector 22 can be attached to the electrical component 24, such as a printed circuit board, by attaching the lower base 100 of the electrical contacts 30 to corresponding pads on the electrical component 24. Specifically, the contacts 30 can be surface mounted to the component 24 via a pad that is coated with solder 52, press-fit, or through-mounted and soldered onto the top surface of the component 24. The mounting plate 50 can likewise be soldered, surface-mounted, or through-mounted to the component to provide support and structural rigidity to the connection between the connector 22 and the component 24. Typically, though not necessarily, the components 24 can be attached to the connector 22 ad 22' prior to attachment of the connectors 22 and 22' to each other.

The attachment of electrical connectors 22 and 22' will now be described with reference to FIGS. 12-15. It should be appreciated that the electrical components 24 are not shown as mounted to the connectors 22 and 22' in FIGS. 12-15, but that the connectors 22 and 22' could be pre-attached to the electrical components 24 if desired. In the description of FIGS. 12-15 below, reference numerals of connector 22' that correspond to like elements of connector 22 are followed by an apostrophe (') for the purposes of clarity and convenience.

Figure 12:
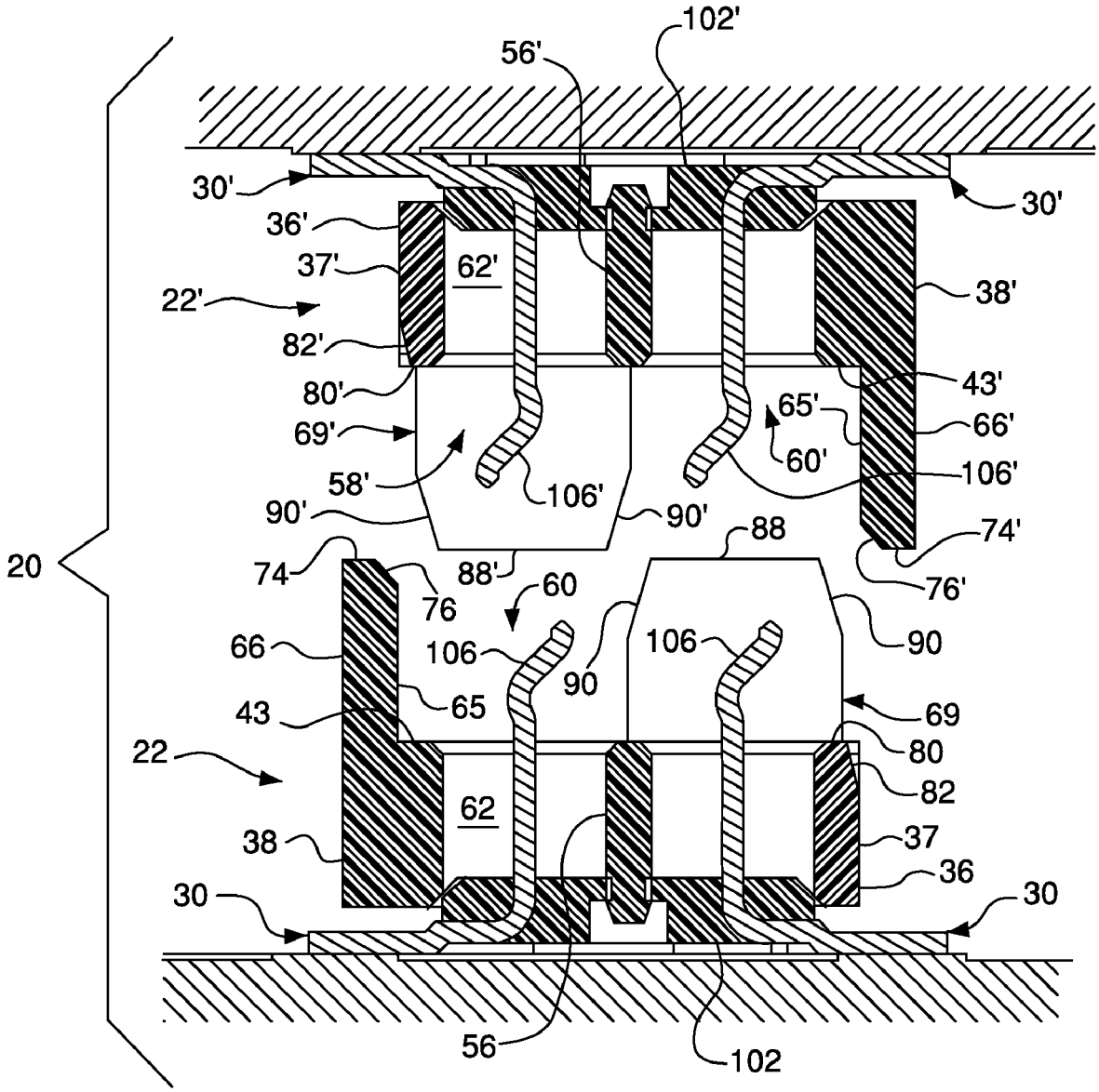
FIG. 12 is a sectional side elevation view of the connectors illustrated in FIG. 2, taken along line 12-12, showing the connectors aligned for attachment.

As illustrated in FIG. 12, the connectors 22 and 22' are generally aligned such that the second engagement tabs 69 and 69' are generally aligned with the second receptacle 95' and 95, respectively, and the first engagement tabs 68 and 68' are generally aligned with the first receptacles 93' and 93, respectively (see also FIGS. 5A-B). The rows 58' and 60' are aligned with the rows 60 and 58, respectively. The spines 56 of each connector 22 and 22' can also generally be in vertical alignment. The laterally inner surfaces 65 and 65' of engagement walls 66 and 66' are generally aligned with the laterally outer surfaces 37 and 37' of side walls 36 and 36', respectively. The upper surfaces 80 and 80' of side walls 37 and 37' are generally aligned with the respective seats 43' and 43 of side walls 38' and 38. The angled cam portions 106 and 106' of the electrical contacts 30 and 30' of each connector 22 and 22' are also generally aligned with each other.

Figure 13:
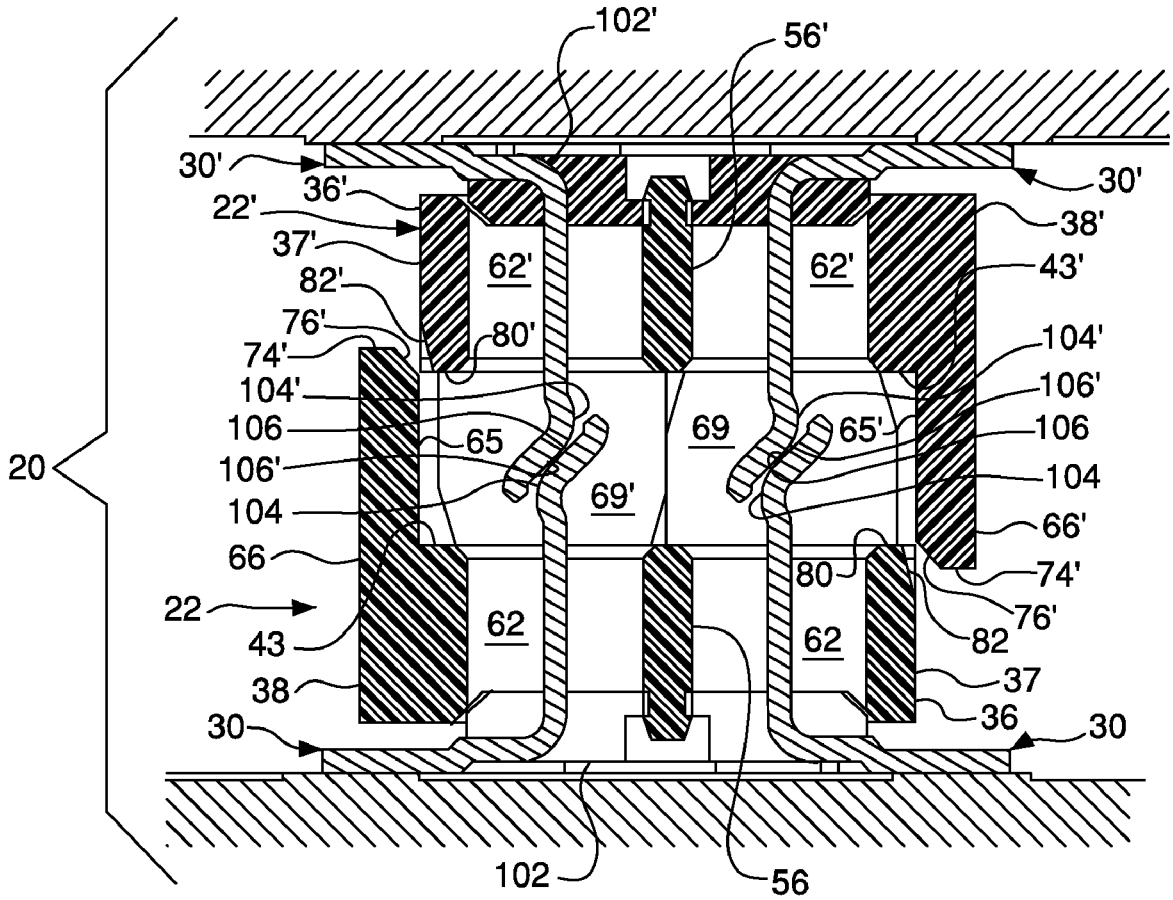
FIG. 13 is a sectional side elevation view of the connectors illustrated in FIG. 12, but showing the connectors engaged for attachment.

Referring now to FIG. 13, as the connectors 22 and 22' are brought into contact with each other, beveled ends 82 and 82' of side walls 36 and 36', the beveled ends 76' and 76 of the engagement walls 66' and 66, and the beveled ends 90 and 90' of the engagement tabs 69 and 69', and of engagement tabs 68 and 68', can assist in aligning the two connectors 22 and 22' for attachment. As the connectors 22 and 22' are brought into contact and further brought together, the angled cam portions 106 and 106' of each mating pair of contacts 30 and 30' ride along each other thus causing each mating pair of contacts 30 and 30' to flex laterally away from each other, which produces a counteracting lateral spring force that biases each mating pair of contacts 30 and 30' against each other. Because the connectors 22 and 22' can mate interchangeably with each other, the electrical connector assembly 20 can be referred to as including gender-neutral, or hermaphroditic, electrical contacts 30.

Figure 14:
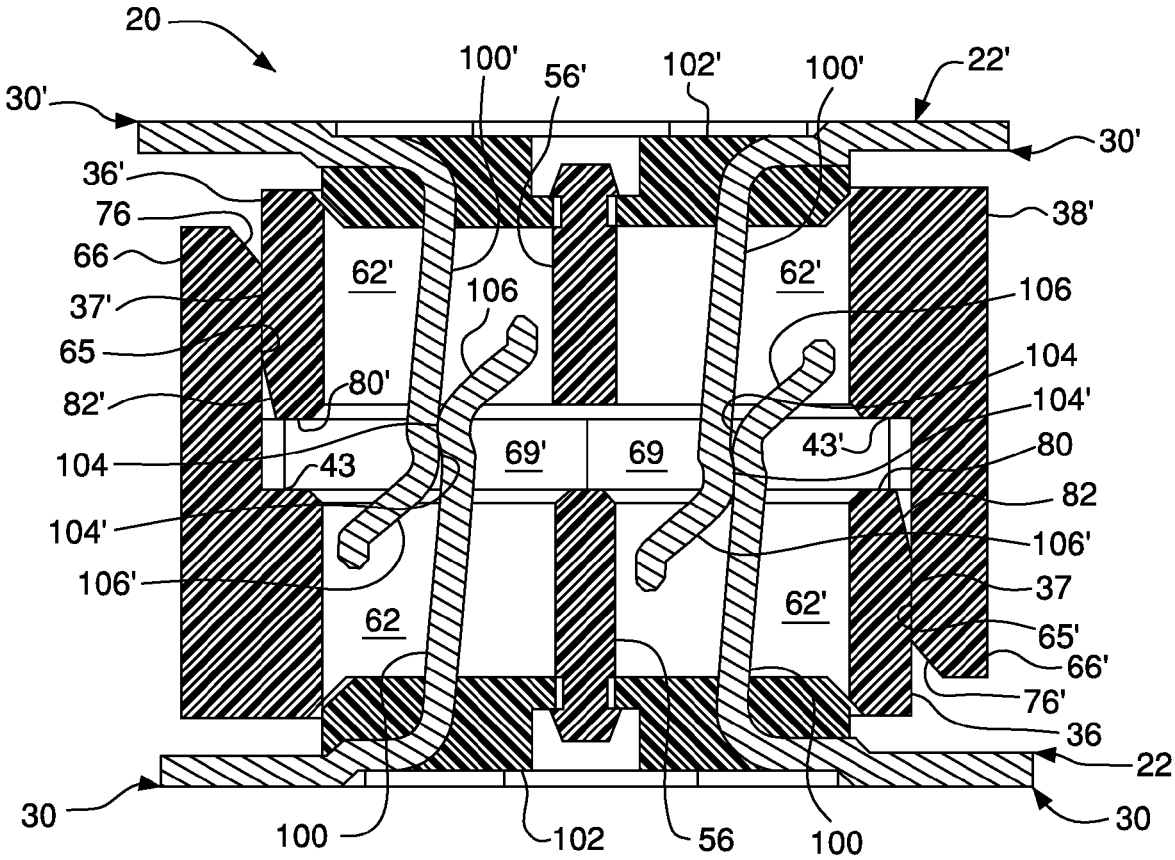
FIG. 14 is a sectional side elevation of the connectors illustrated in FIG. 13, but showing the connectors in an attached configuration.

Referring now to FIG. 14, when the connectors 22 and 22' are brought to an attached configuration, the engagement tabs 69 and 69' are inserted into receptacles 95' and 95, respectively. Likewise, engagement tabs 68 and 68' are inserted into receptacles 93' and 93, respectively. The engagement tabs 68 and 68' and engagement tabs 69 and 69' thus engage each other to prevent or limit relative movement between the connectors 22 and 22' in a lateral direction. It should be appreciate that the engagement tabs 69 and 69' and engagement tabs 68 and 68' are mating walls that each provide complementary engagement surfaces that engage each other at a location laterally between the rows of electrical contacts 30 and 30'. In the illustrated embodiment, the engagement tabs 69 and 69' and engagement tabs 68 and 68' engage each other at locations longitudinally outboard of the contacts 30 and 30' supported in the connector housings 26 and 26'.

Furthermore, as the connectors 22 and 22' are brought to the attached configuration, the jogs 104 and 104' of the each pair of mating contacts 30 and 30' slide past each other and engage the opposing stems 100' and 100, respectively. Because at least a portion of the jogs 104 and 104' overlap each other vertically, the biasing lateral spring force of the contacts 30 and 30' prevents the connectors 22 and 22' from becoming inadvertently detached. The connectors 22 and 22' can be detached by pulling the connectors apart with a force sufficient to allow the jogs 104 and 104' to slide past each other against the lateral spring force.

Furthermore, when the connectors 22 and 22' are in the attached configuration, the laterally inner surfaces 65 and 65' of engagement walls 66 and 66' can abut (or face) the laterally outer surfaces 37 and 37' of side walls 36 and 36', respectively. The upper surfaces 80 and 80' of side walls 37 and 37' remain aligned with the respective seats 43' and 43 of side walls 38' and 38.

Figure 15:
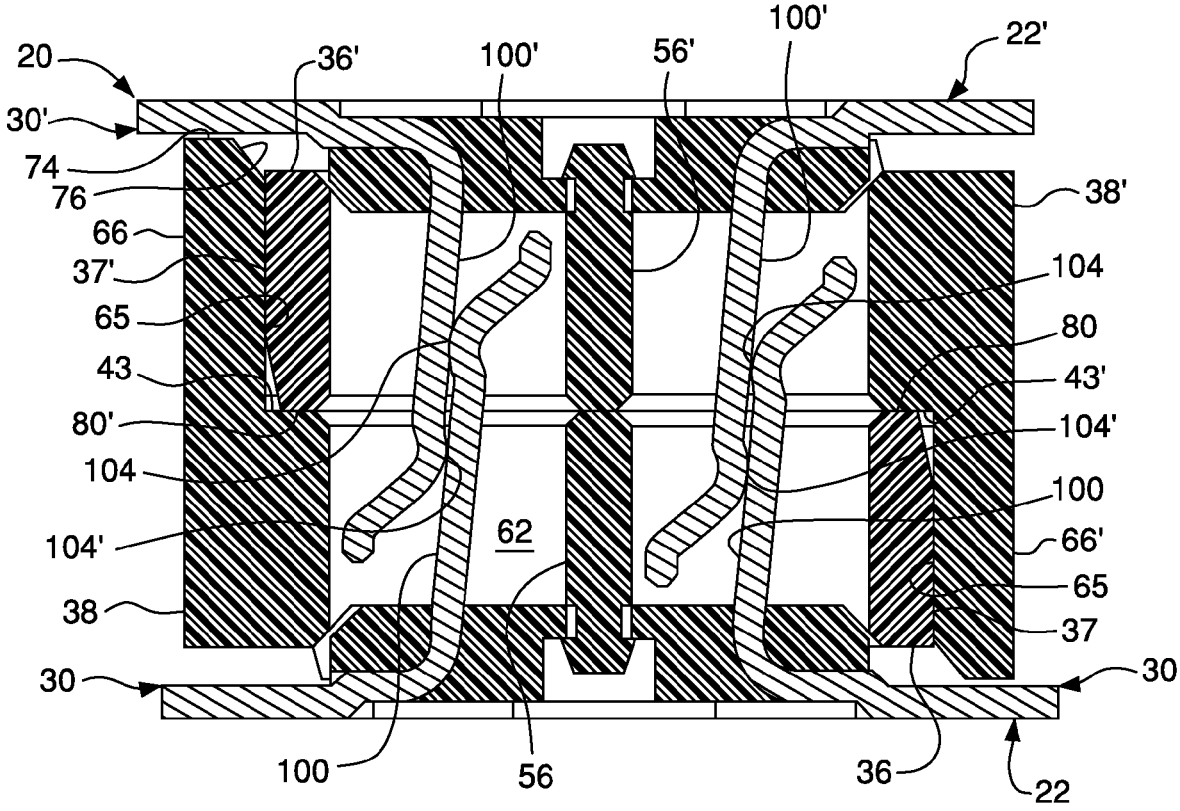
FIG. 15 is a sectional side elevation view of the connectors illustrated in FIG. 14, but showing the connectors in an attached and fully seated configuration.

Referring now to FIG. 15, the connectors 22 and 22' can be further attached and brought into a fully seated configuration whereby the connectors 22 and 22' cannot be further inserted into each other. In the fully seated configuration, one or more of the upper ends of the spines 56 and 56' and dividers 62 and 62' can contact each other. The upper ends 80 and 80' of side walls 36 and 36' can be seated against the opposing seats 80' and 80, respectively.

In the fully seated configuration, the connector assembly 20 has a height only slightly greater than the height of the individual connectors 22 and 22' due to the clearance between the electrical contacts 30 and 30' and the upper ends of the engagement walls 66' and 66, respectively. In accordance with certain aspects of the present invention, the connector assembly 20 can have a height between 1% and 20%, or alternatively between 3% and 10%, greater than the height of one of the connectors 22 or 22' alone. For instance, the connector assembly 20 can have a height between approximately 5 mm and 8 mm, including approximately 5 mm, approximately 6 mm, approximately 7 mm, and approximately 8 mm. The height of the connector assembly 20 can also be variable as the connectors 22 and 22' can be attached at a fully unseated position illustrated in FIG. 14 whereby the lower ends of the jogs 104 and 104' are in contact, or at the fully seated position illustrated in FIG. 15, or anywhere between the unseated position and the fully seated position.

While the connector assembly 20 provides a "mezzanine" style connector (e.g., configured to connect the electrical components 24 in a parallel, but vertically spaced, relationship), the present invention recognizes that the connector assembly 20 can connect the electrical components 24 in alternative relationships without departing from the spirit and scope of the present invention.

Figure 16:
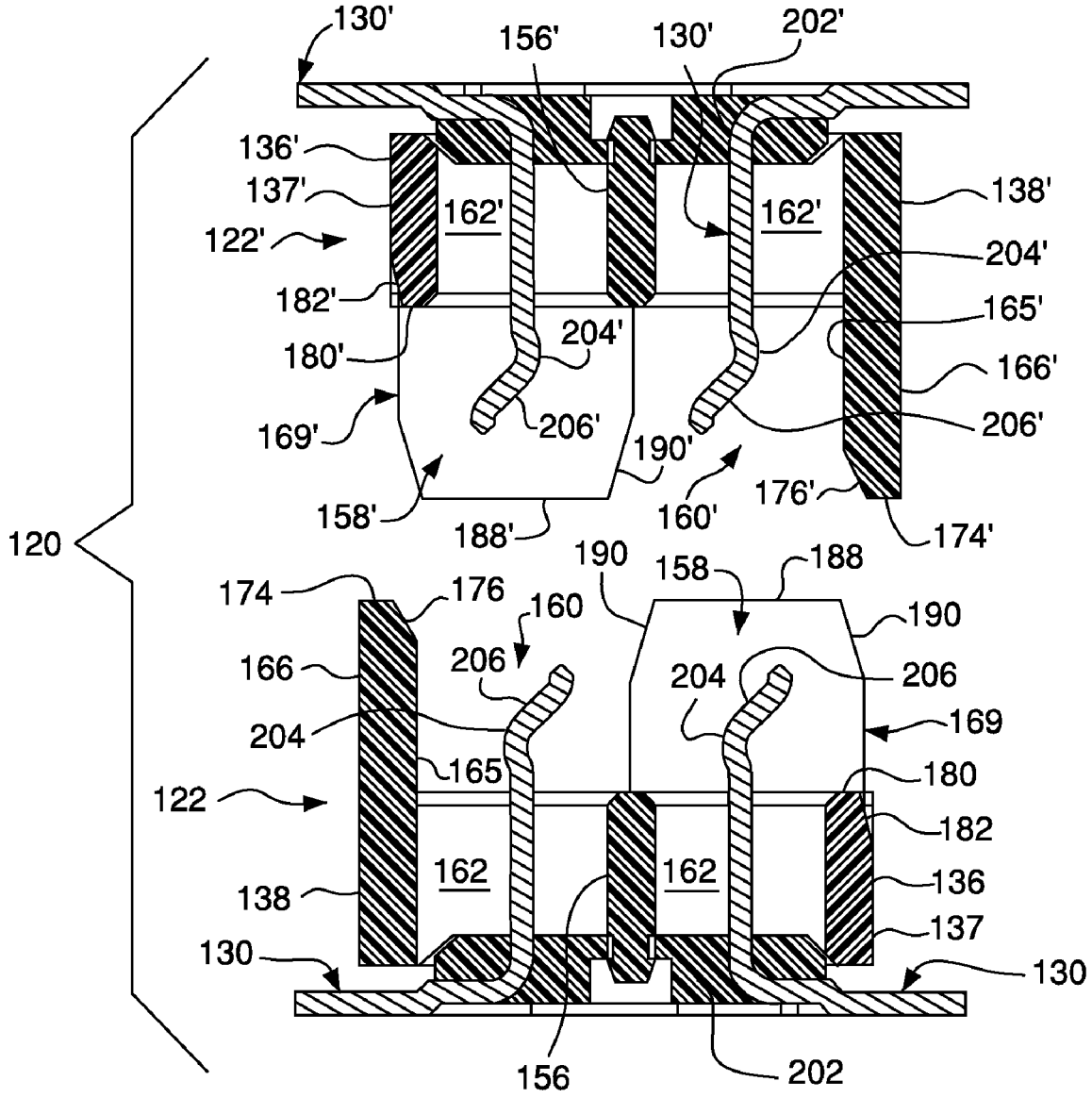
FIG. 16 is a sectional side elevation view similar to FIG. 10, but showing a connector constructed in accordance with an alternative embodiment.
Figure 17:
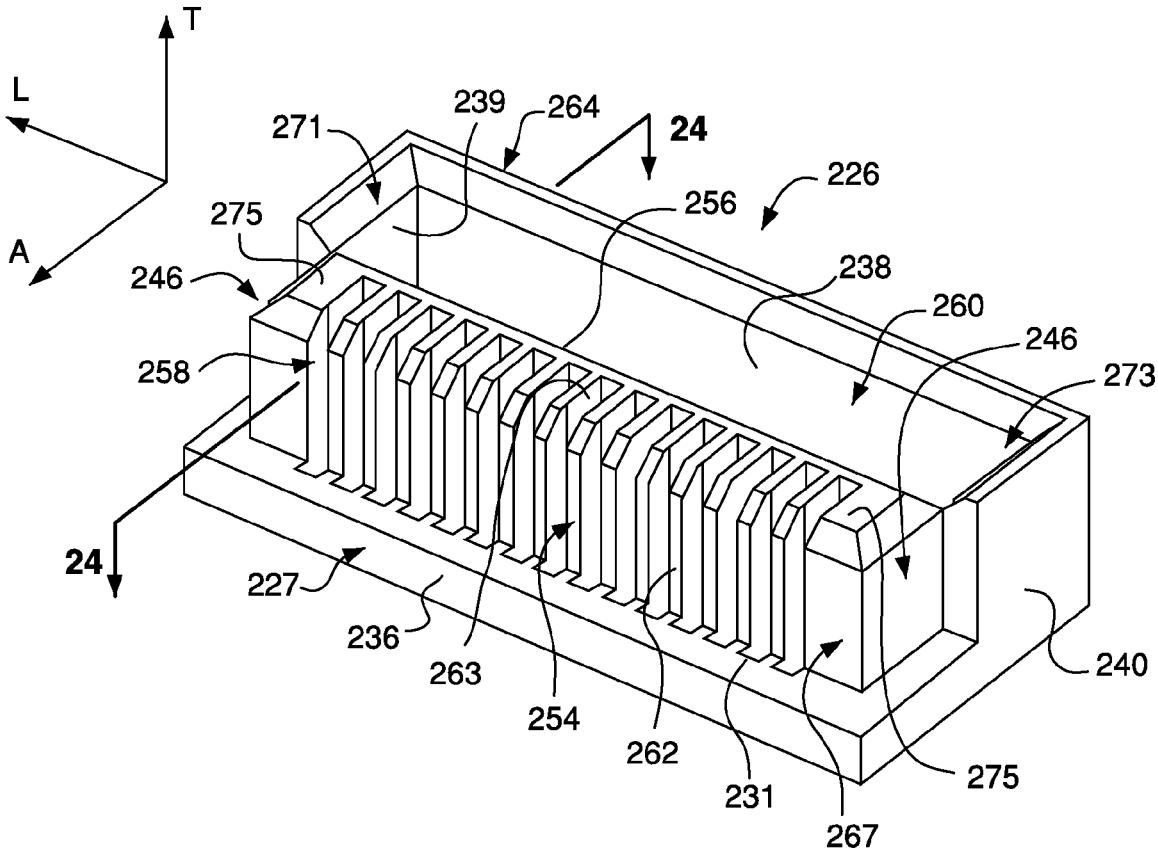
FIG. 17 is a perspective view of an electrical connector housing constructed in accordance with an alternative embodiment.
Figure 18:
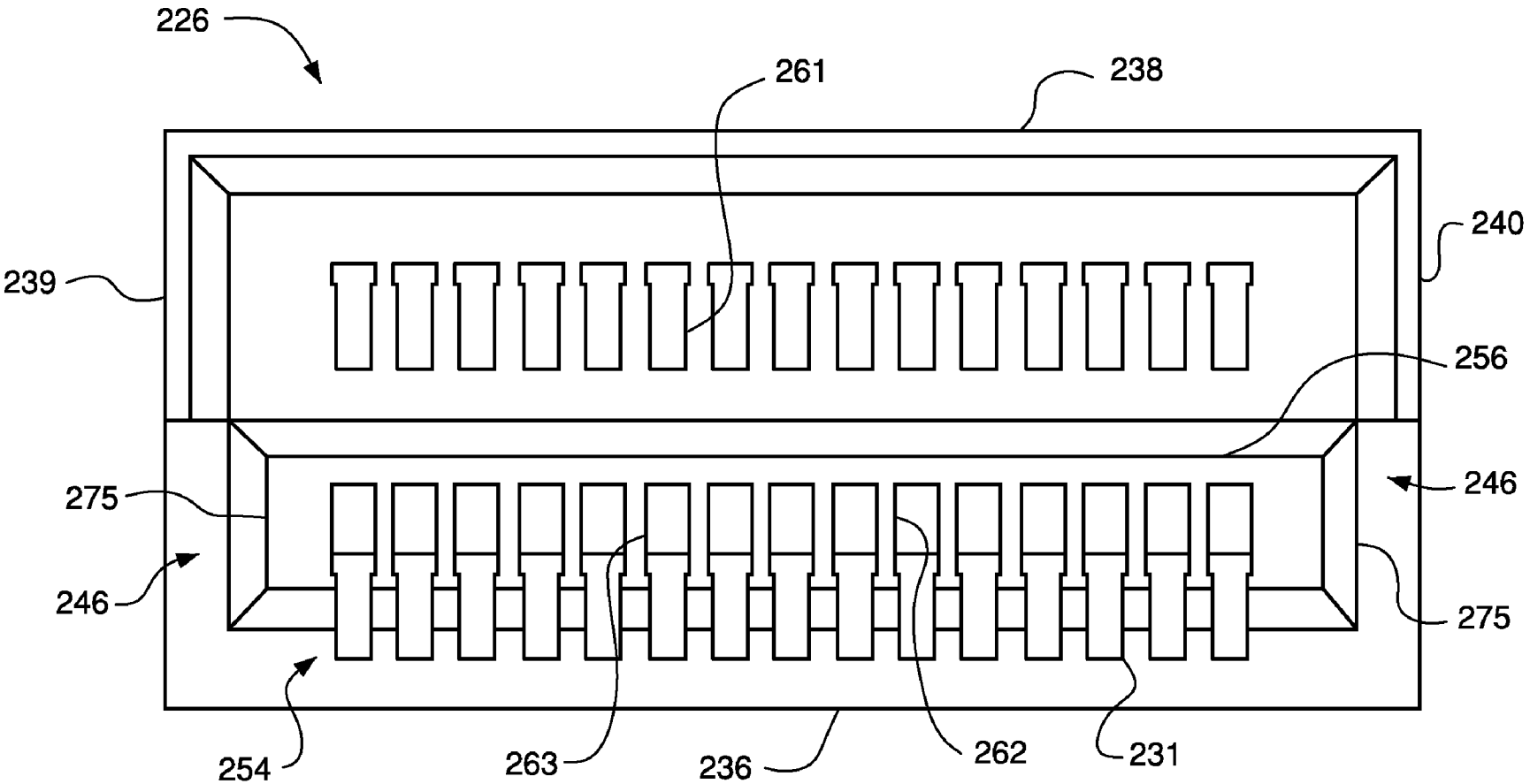
FIG. 18 is a top plan view of the housing illustrated in FIG. 17.
Figure 19:
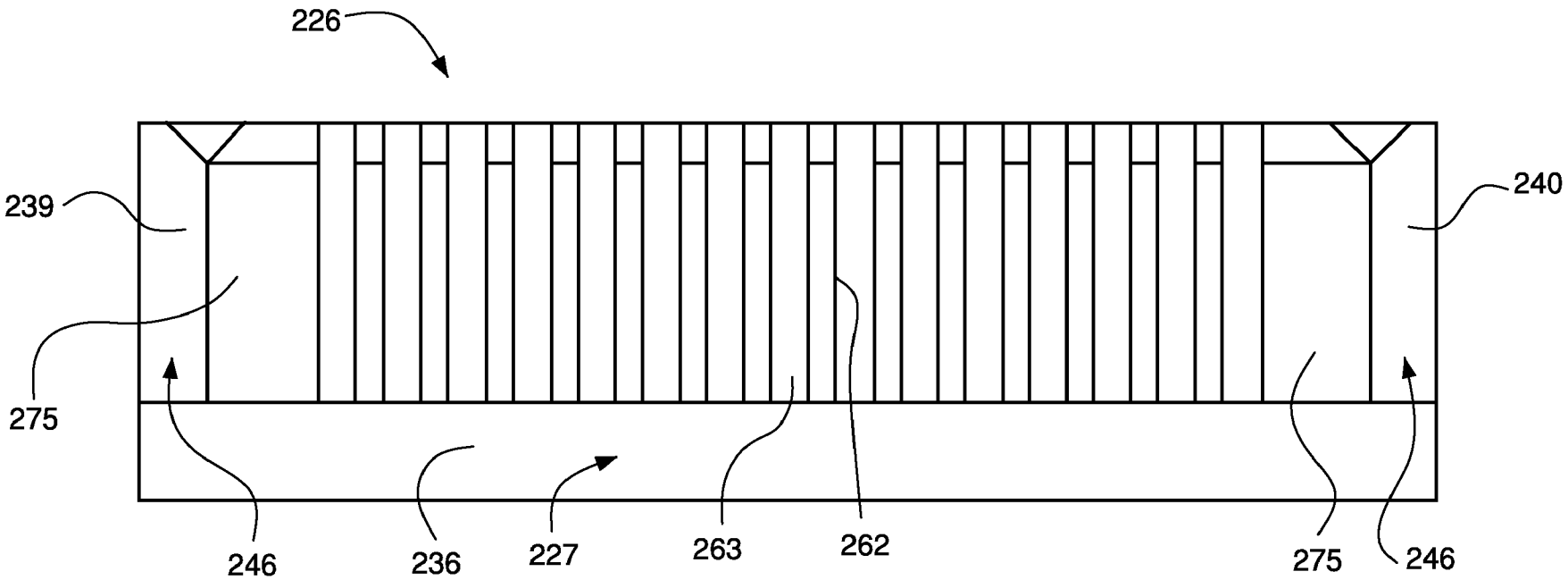
FIG. 19 is a front elevation view of the housing illustrated in FIG. 17.
Figure 20:
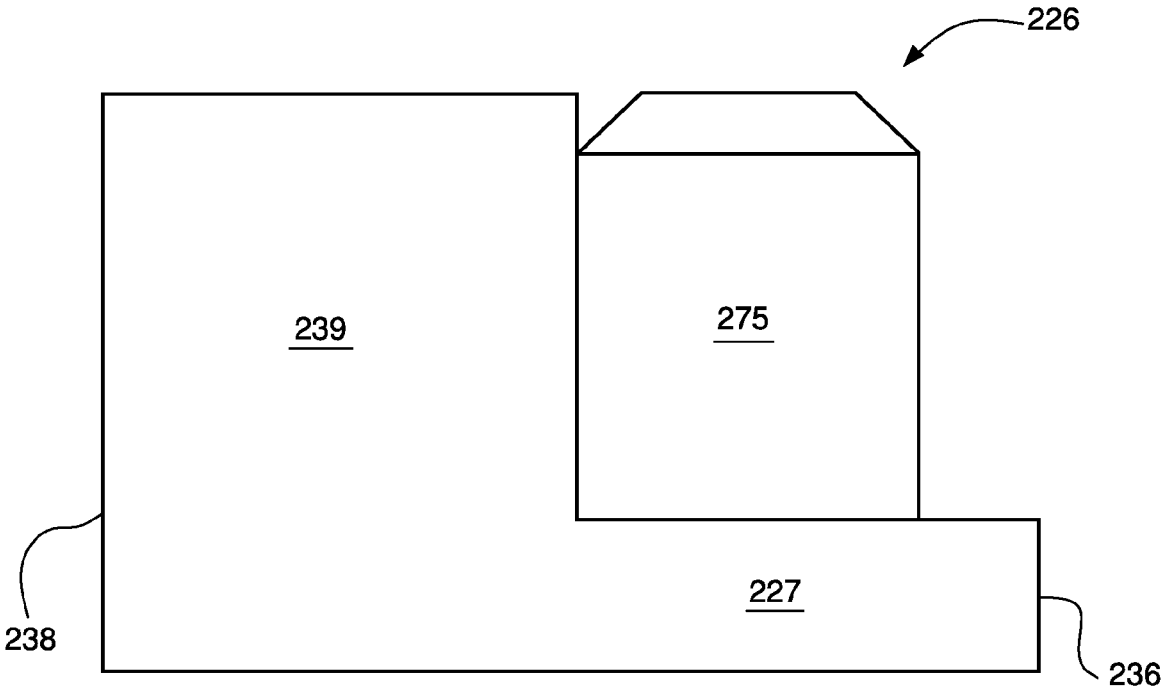
FIG. 20 is a left side elevation view of the housing illustrated in FIG. 17.
Figure 21:
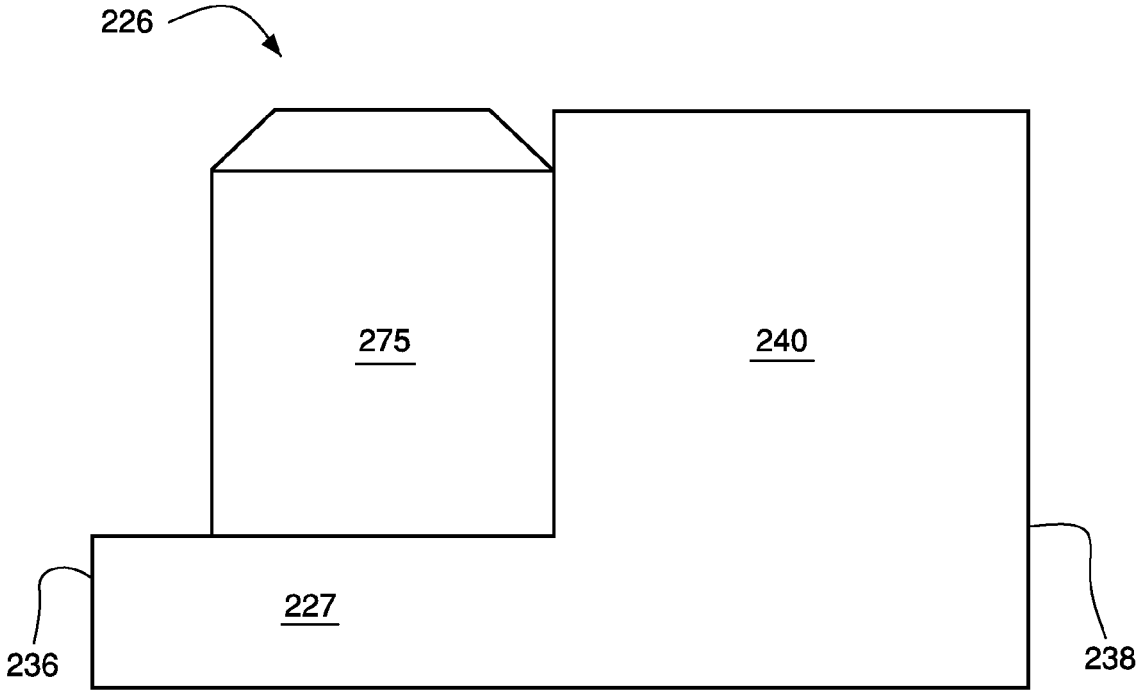
FIG. 21 is a right side elevation view of the housing illustrated in FIG. 17.
Figure 22:
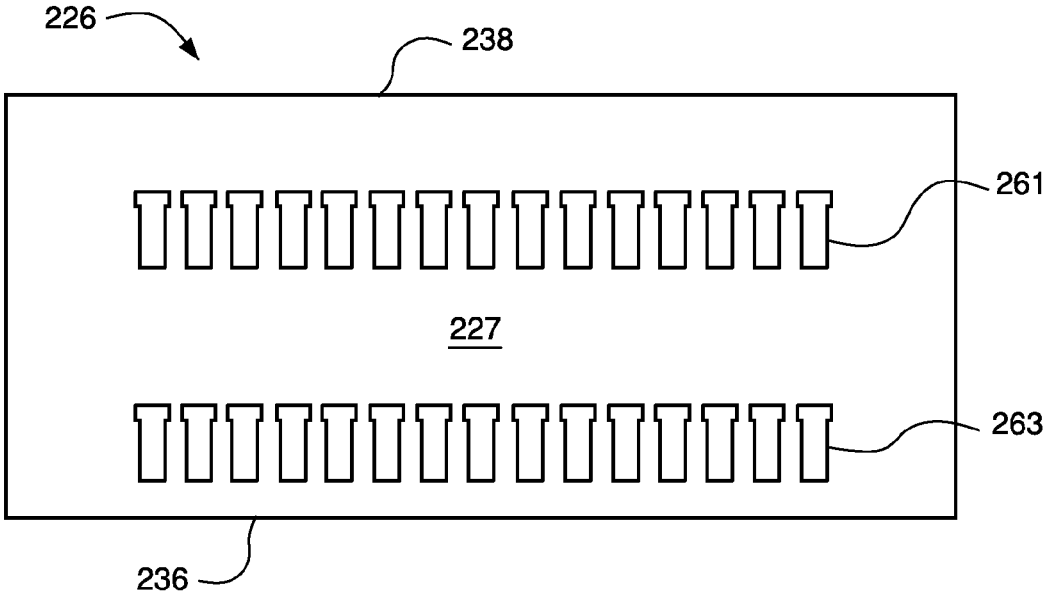
FIG. 22 is a bottom plan view of the housing illustrated in FIG. 17.
Figure 23:
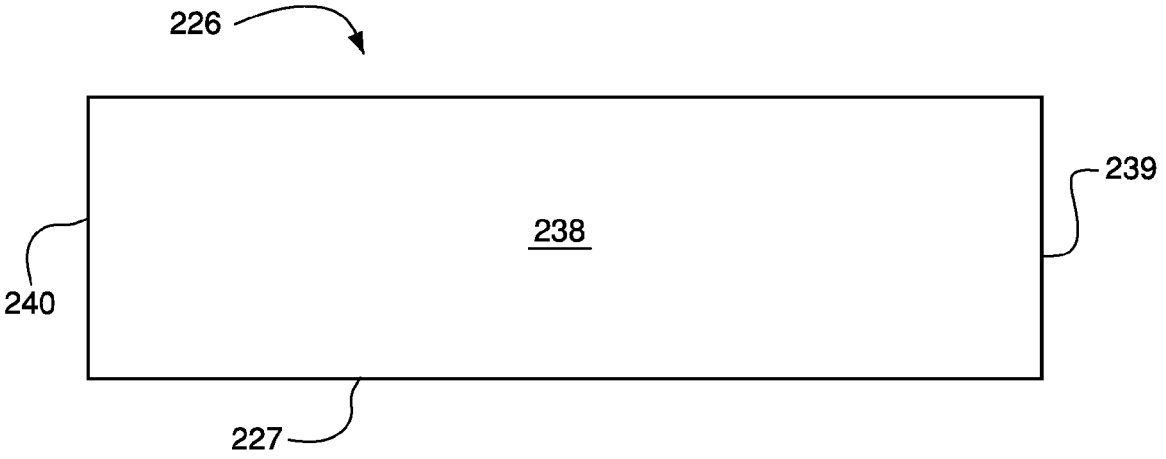
FIG. 23 is a rear elevation view of the housing illustrated in FIG. 17.

While the connector assembly 20 has been described in accordance with one embodiment of the present invention, it should be appreciated that unless otherwise specified, the connector 22 constructed in accordance with the present invention is intended to encompass connectors of alternative embodiments that allow opposing gender-neutral electrical contacts to attach to each other when the connectors are attached. One such alternative connector assembly 120 is illustrated in FIG. 16, having reference numerals corresponding to like elements of connector assembly 20 incremented by 100 purposes of clarity and convenience.

The connector 122 is similarly constructed with respect to the connector 22, however the engagement wall 166 extends vertically up from the side wall 138. Accordingly, when the opposing connector is attached to the connector 122, the beveled ends 82 and 82' of side walls 36 and 36' engage the opposing beveled ends 76' and 76 of the engagement walls 66' and 66, respectively. As the connectors 22 and 22' are further attach, they become laterally offset with respect to each other so that the outer lateral surfaces 137 and 137' become aligned with laterally inner surfaces 165 and 165'. The spines 156 and 156' are thus laterally offset when the connectors 122 and 122' are attached, which produces a greater lateral spring force in the contacts 130 and 130' when the jogs 204' slide past jogs 204.

Referring now to FIGS. 17-32 generally, a connector assembly 220 (see FIGS. 31-32) constructed in accordance with another alternative embodiment is illustrated having reference numerals corresponding to like elements of connector assembly 20 incremented by 200 purposes of clarity and convenience. The connector assembly 220 includes a pair of connectors 222 and 222' configured for attachment in a manner similar to that described above with respect to connectors 22 and 22'. Because each connector 222 and 222' is similarly or identically constructed and interchangeable with the each other, only connector 222 is described in detail below. It should therefore be appreciated that the description of connector 222 equally applies to the description of the corresponding connector 222' unless otherwise specified.

As illustrated in FIG. 17-23, a connector housing 226 is provided, and can be formed from a dielectric material, such as plastic for example. The housing 226 is illustrated as being generally rectangular in shape, and can extend horizontally along a longitudinal direction "L" and lateral direction "A", and vertically along a transverse direction "T". The housing is elongate in the longitudinal direction L. Unless otherwise specified herein, the terms "lateral," "longitudinal," and "transverse" as used to describe the orthogonal directional components of the connector housing 226 are likewise used to describe the directional components of the remainder of the connector assembly 220. The terms "inboard" and "inner," and "outboard" and "outer" with respect to a specified directional component are used herein with respect to a given apparatus to refer to directions along the directional component toward and away from the center apparatus, respectively.

Figure 30:
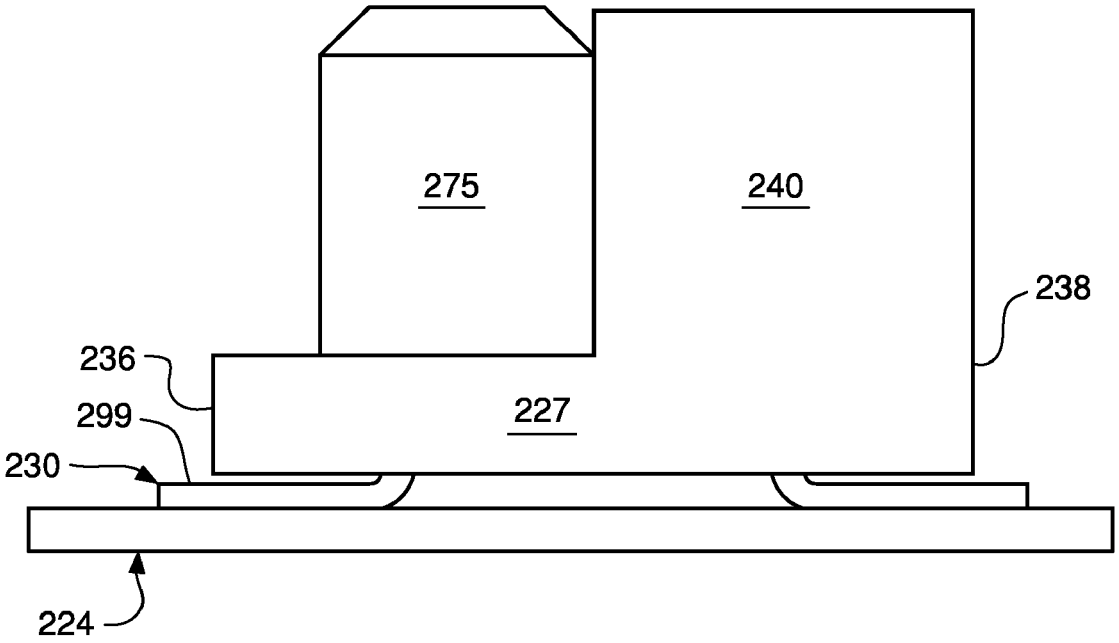
FIG. 30 is a right side elevation view of the connector illustrated in FIG. 26 connected to a substrate.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the connected electrical components 224 (see FIG. 30). Accordingly, the terms "vertical" and "horizontal" are used to describe the connector assembly 220 as illustrated merely for the purposes of clarity and convenience, it being appreciated that these orientations may change during use.

Each connector housing 226 defines a base 227 that includes a pair of opposing longitudinally elongate side walls 236 and 238 connected at their longitudinally outer ends by first and second opposing laterally elongate end walls 239 and 240, respectively. The side wall 236 has a height less than that of the side wall 238. Each end wall 239 and 240 extends laterally from the side wall 238 to a location substantially midway between the side walls 236 and 238. A cutout portion 246 thus extends laterally between the side wall 236 to a location substantially midway between the side walls 236 and 238. The cutout portions 246 define a height that is substantially equal to that of the side wall 236, or base 227, while the end walls 239 and 240 have a height substantially equal to the height of side wall 238. The side walls 236 and 238, cut out portions 246, and end walls 239 and 240 define a perimeter that can retain at least a portion of an electrical contact assembly 228 that includes a plurality of electrical contacts 230 (see FIGS. 25-26).

With continuing reference to FIGS. 17-23, the housing 226 defines a contact support assembly 254 that is configured to receive the electrical contact assembly 228, and an engagement assembly 264 that is configured to mate with the engagement assembly of the corresponding connector 222' when the connectors 222 and 222' are attached.

The contact support assembly 254 can include a longitudinally elongate spine 256 extending between the end walls 239 and 240 at a location laterally offset toward the side wall 236 with respect to a lateral midline disposed between the side walls 236 and 238. The spine 256 can be a vertical wall having an upper end that can be generally coplanar with, or disposed below, the upper ends of the side wall 238 and end walls 239 and 240 so that the upper ends of the end walls 239 and 240 and the side wall 238 of each connector 22 and 22' can seat against the base 227 at the cutout portions 246 and at the side wall 236, respectively, of the other connector when the connectors 22 and 22' are attached.

Figure 24:
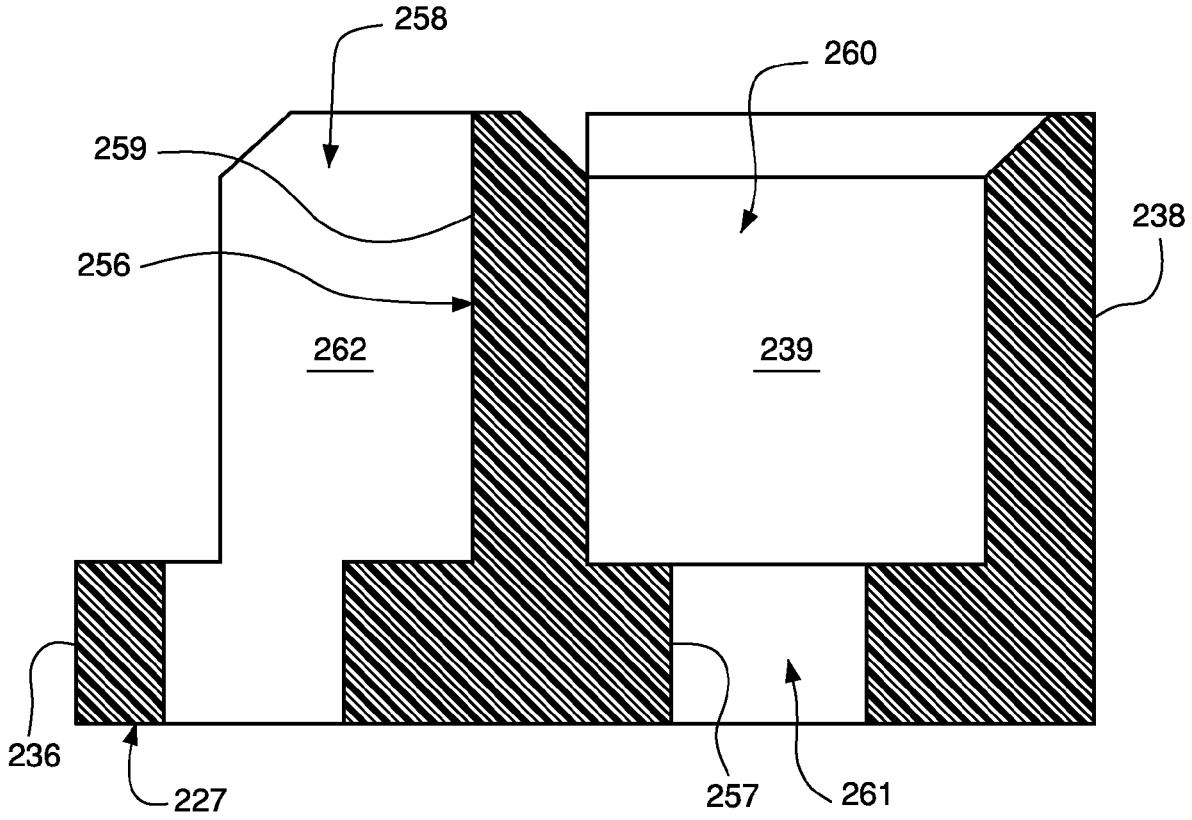
FIG. 24 is a sectional side elevation view of the housing illustrated in FIG. 17, taken along line 24-24.

Referring also to FIG. 24, the spine 256 can define a laterally elongate lower end 257 that forms part of the base 227, and a vertical wall 259 extending up from the lower end 257. The vertical wall 259 can be positioned laterally centrally with respect to the lower end 257 or, can be offset with respect to the lateral center. In accordance with the illustrated embodiment, the vertical wall 259 is offset slightly toward the side wall 238 of the housing 226.

Referring again also to FIG. 17, the spine 256 cooperates with the end walls 240 and 239 and with the side wall 238 to divide the housing 236 into first and second laterally spaced rows 258 and 260 that are configured to receive corresponding rows of the electrical contacts 230. The first row 258 is disposed adjacent the side wall 236, while the second row 260 is disposed adjacent the side wall 238. Each row 258 and 260 defines a first longitudinal end 271 disposed proximal the first end wall 239, and a second opposing longitudinal end 273 disposed proximal the second end wall 240.

The contact support assembly 254 can further include a plurality of dividers 262 disposed in the first row 258. The plurality dividers 262 can be supported by a frame 267 that includes the spine 256 and posts 275 disposed at the longitudinally outer ends of the spine. The posts 275 have a height substantially equal to the height of the end walls 239 and 240. Each divider 262 can be a vertical wall that extends laterally between the spine 256 and the corresponding side wall 236. Each divider 262 can terminate at a location laterally inboard of the side wall 236 as illustrated. The dividers 262 can be sized so as to nest in the row 260 of an opposing connector, as will be described in more detail below.

The second row 260 can include dividers if desired, or can be devoid of dividers as illustrated. If the second row 260 is devoid of dividers, then the second row 260 can be provided in the form of a longitudinally elongate opening that receives a plurality of the contacts 230, or all contacts 230, in the row 260. If the second row 260 includes dividers, the dividers could extend to a height equal to that of the dividers 262, or could extend to a height less than that of the dividers 262 so as to enable the first row 258 of contacts 230 to nest within the second row 260 of contacts 230. Alternatively still, any row of contacts described herein, including row 260, can include in combination an opening that receives multiple contacts and dividers that receive individual contacts 230.

The dividers 262 can be longitudinally spaced from each other to divide the rows 258 into a plurality of contact receptacles 263 that are each disposed between adjacent dividers 262. Each receptacle 263 can extend vertically between adjacent dividers 262 and through the base 227 of the housing 226. The receptacles 263 define a longitudinal thickness greater than that of the electrical contacts 230, and are thus configured to receive one of the electrical contacts 230. A notch 231 projects laterally outboard from the lower end of each receptacle 263 and extends into the base 227 of the housing 226. The notches 231 extend vertically through the base 227 and assist in attaching the electrical contacts 230 to the housing 226.

Figure 31:
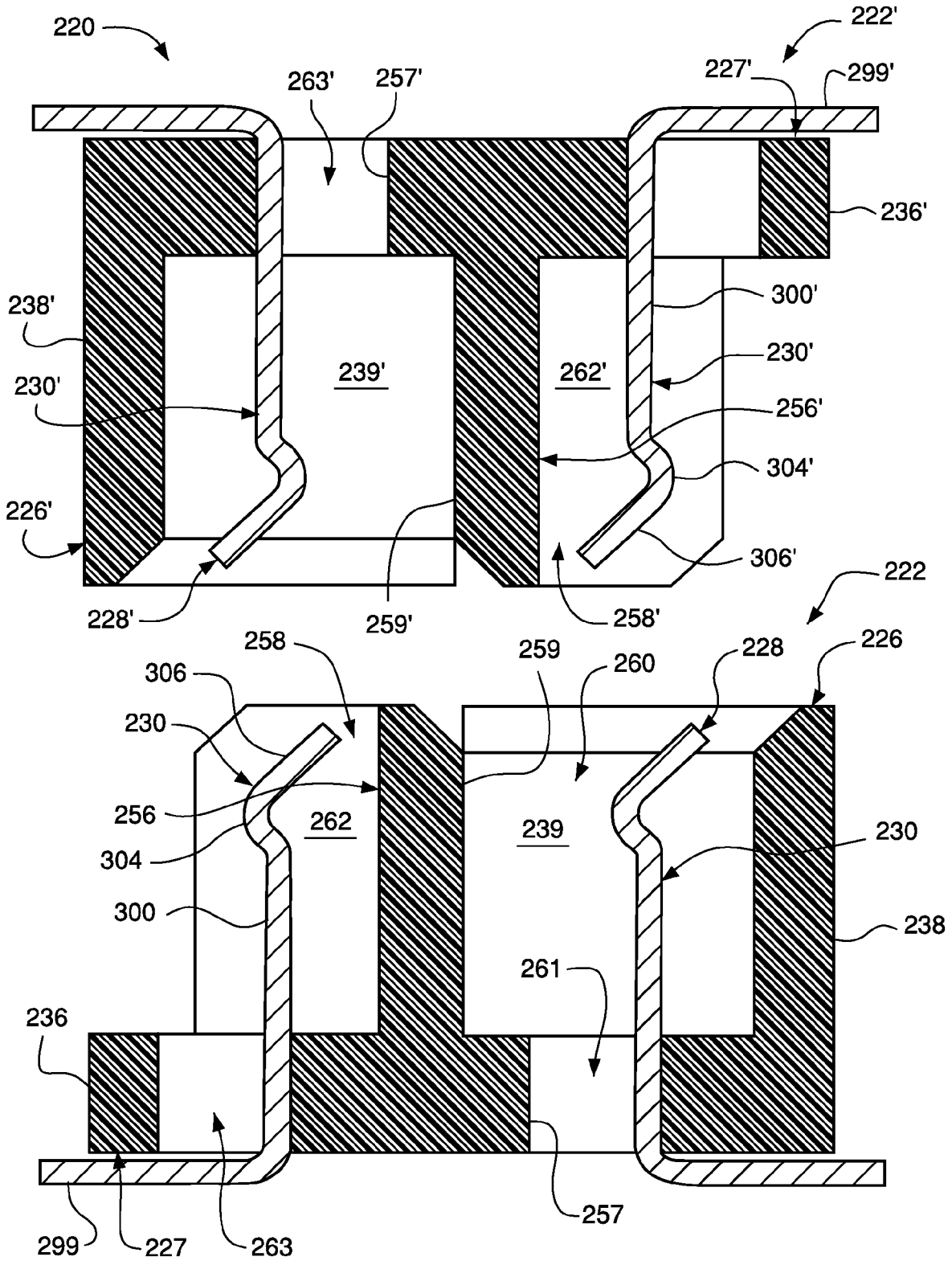
FIG. 31 is a sectional side elevation view of an electrical connector assembly including a pair of connectors of the type illustrated in FIG. 26 aligned for attachment.
Figure 32:
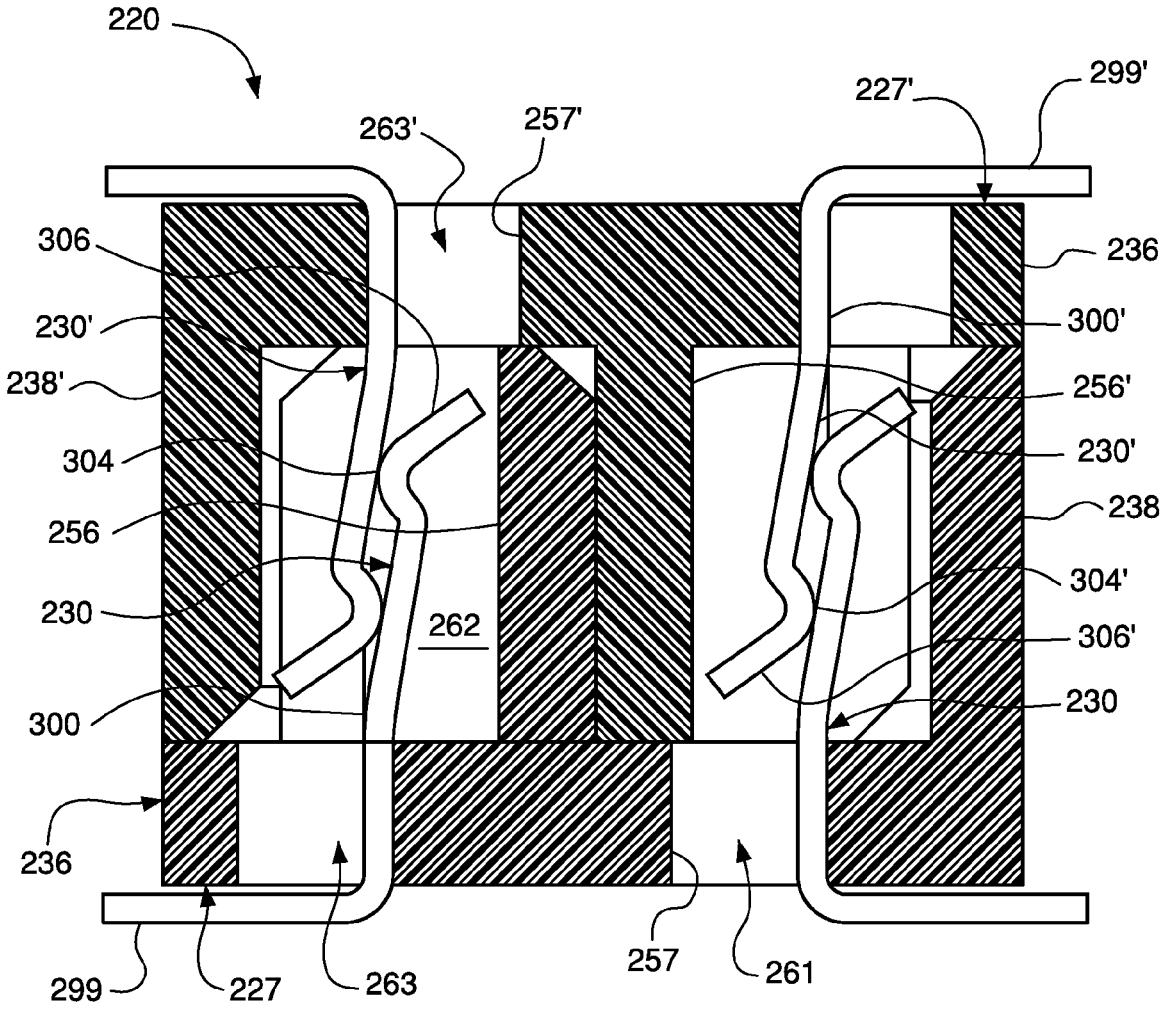
FIG. 32 is a sectional side elevation view of the connectors illustrated in FIG. 31, but showing the connectors in an attached and fully seated configuration.

The second row 260 can also include a plurality of longitudinally spaced openings 261 that extend vertically through the base 227 of the housing 226. The openings 261 and the portions of the receptacles 263 that extend through the base can be substantially laterally aligned, and can include a lateral end that defines an increased longitudinal dimension. Because the row 258 of connector 222 mates with the row 260 of the corresponding connector 222', and row 260 of connector 222 mates with row 258 of connector 222' when the connectors are attached, the receptacles 263 of row 258 are aligned with row 260 so that the electrical contacts 230 of the connectors 222 and 222' can engage when the connectors are attached as shown in FIGS. 31 and 32.

The upper ends of the dividers 262 can be substantially co-planar with the upper end of the spine 256 such that the dividers 262 of the connectors 222 and 222' can seat against each other when the connectors are attached. Alternatively, one or more of the dividers 262 can define an upper surface disposed above the spine 256, and the complementary dividers 262 of the corresponding connector 222' that are aligned with the dividers 262 have a reduced height so that the engagement of the dividers 262 of connectors 222 and 222' does not interfere with the seating engagement of the two connectors. The upper ends of the dividers 262 can extend substantially horizontal as illustrated, or can be angled with respect to the horizontal While the upper ends of the dividers 262, spine 256, and end walls 239 and 240 of the connectors 222 and 222' are described and illustrated as being substantially co-planar and can seat against each other when the connectors 222 and 222' are attached, it should be appreciated that one or more of the dividers 262, spine 256, and end walls 239 and 240 can have a height less than the other components such that one of the components provides a seating surface when the two connectors 222 and 222' are attached.

The engagement assembly 264 can include the side walls 236 and 238, end walls 239 and 240, and the longitudinally outer ends of the row 258. The upper surfaces of the end walls 239 and 240, the side wall 238, and the spine 25 can be beveled outwardly, and the upper surfaces of the longitudinally outer ends of the row 258 can be beveled inwardly so as to assist in aligning the rows 258 and 260 when the connectors 222 and 222' are attached.

The side wall 238 extends vertically up from the base 227 a distance that is substantially equal to or greater than the height of the dividers 262. The side wall 238 has a lateral thickness substantially equal to the lateral distance between the side wall 236 and the dividers 262. Accordingly, the portion of the base 227 extending laterally outboard from the dividers can provide a seat 243 that abuts the upper end of the side wall 236 of the opposing connector when the connectors 222 and 222' are mated.

Likewise, the end walls 239 and 240 extend vertically up from the base 227 a distance that is substantially equal to or greater than the height of the dividers 262. The end walls 239 and 240 have a longitudinal thickness substantially equal to the longitudinal depth of the cutout portions 246. Accordingly, the portion of the base 227 that is in vertical alignment with the cutout portions 246 can provide a seat 243 that abuts the upper end of the end walls 239 and 240 when the connectors 222 and 222' are mated.

Referring now to FIGS. 25-29, the connector housing 226 supports an electrical contact assembly 228 that includes a plurality of electrically conductive contacts 230. The electrical contacts 230 are configured to be installed in the housing in a first row 258 and a second row 260 corresponding to the first and second rows 258 and 260 of the connector housing 226, respectively. Each contact 230 has a first terminal 232 configured for attachment to the complementary electrical component 224, and a second terminal 234 configured for attachment to the second terminal of the complementary or mating electrical connector 222' of the electrical connector assembly 220. As will be appreciated from the description below, the second terminals 234 of the contacts 230 are gender neutral, thus allowing for general interchangeability between connectors of a connector assembly.

The contacts 230 can define a rectangular cross section as illustrated, or can alternatively have a cross section that is circular, or that defines a square or any alternative suitable geometry. The contacts 230 can be made from any suitable electrically conductive material. Each electrical contact 230 of a given row is similarly constructed, and extends parallel to the other contacts 230 of that row. Likewise, the contacts of both rows 258 and 260 are similarly constructed, and extend parallel to each other. Accordingly, one exemplary contact 230 will be described, it being appreciated that the description of the exemplary contact 230 can apply to all contacts 230.

Figure 25:
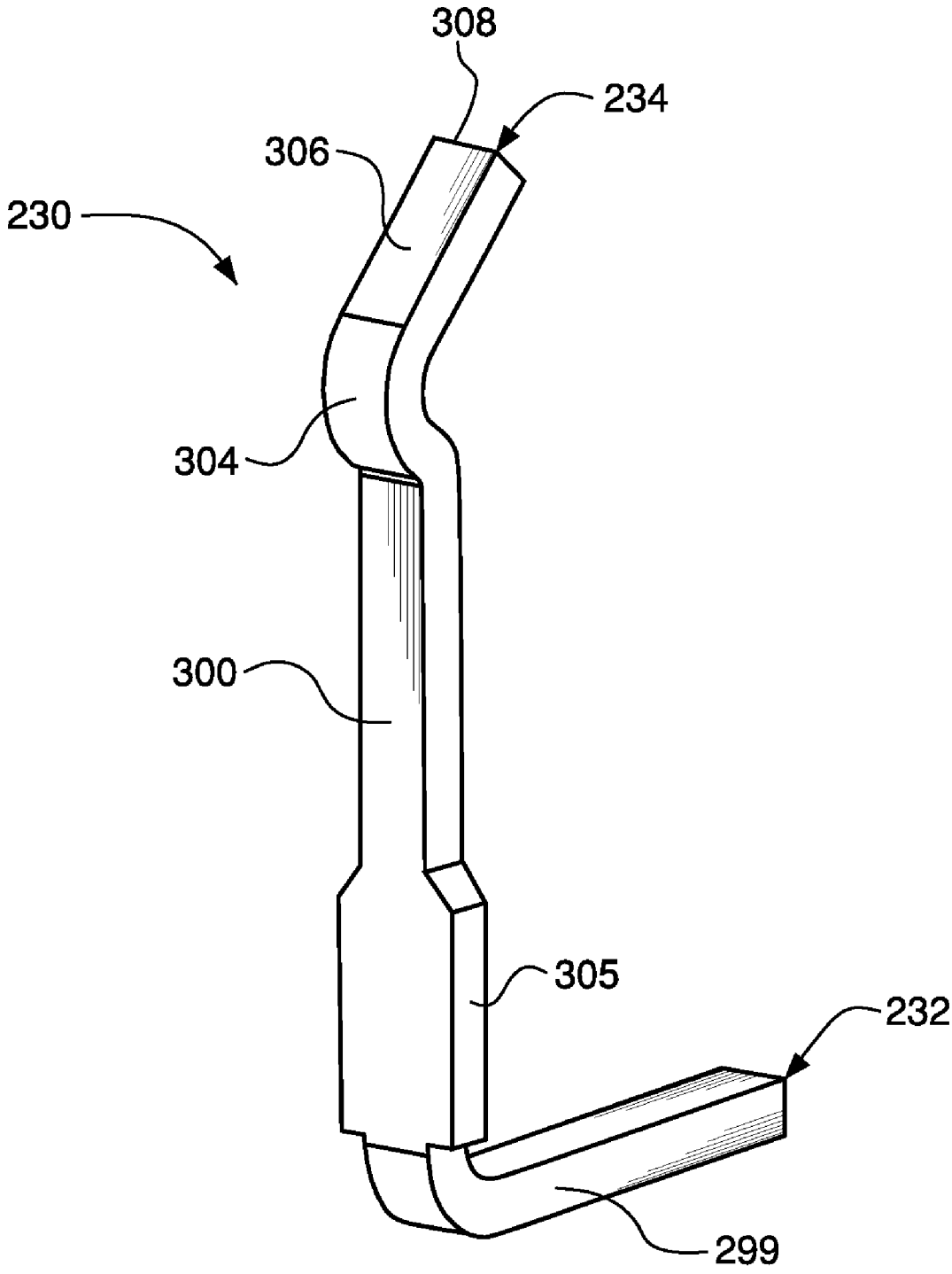
FIG. 25 is a perspective view of one of a plurality of electrical contacts configured to be retained by the housing illustrated in FIG. 17.
Figure 26:
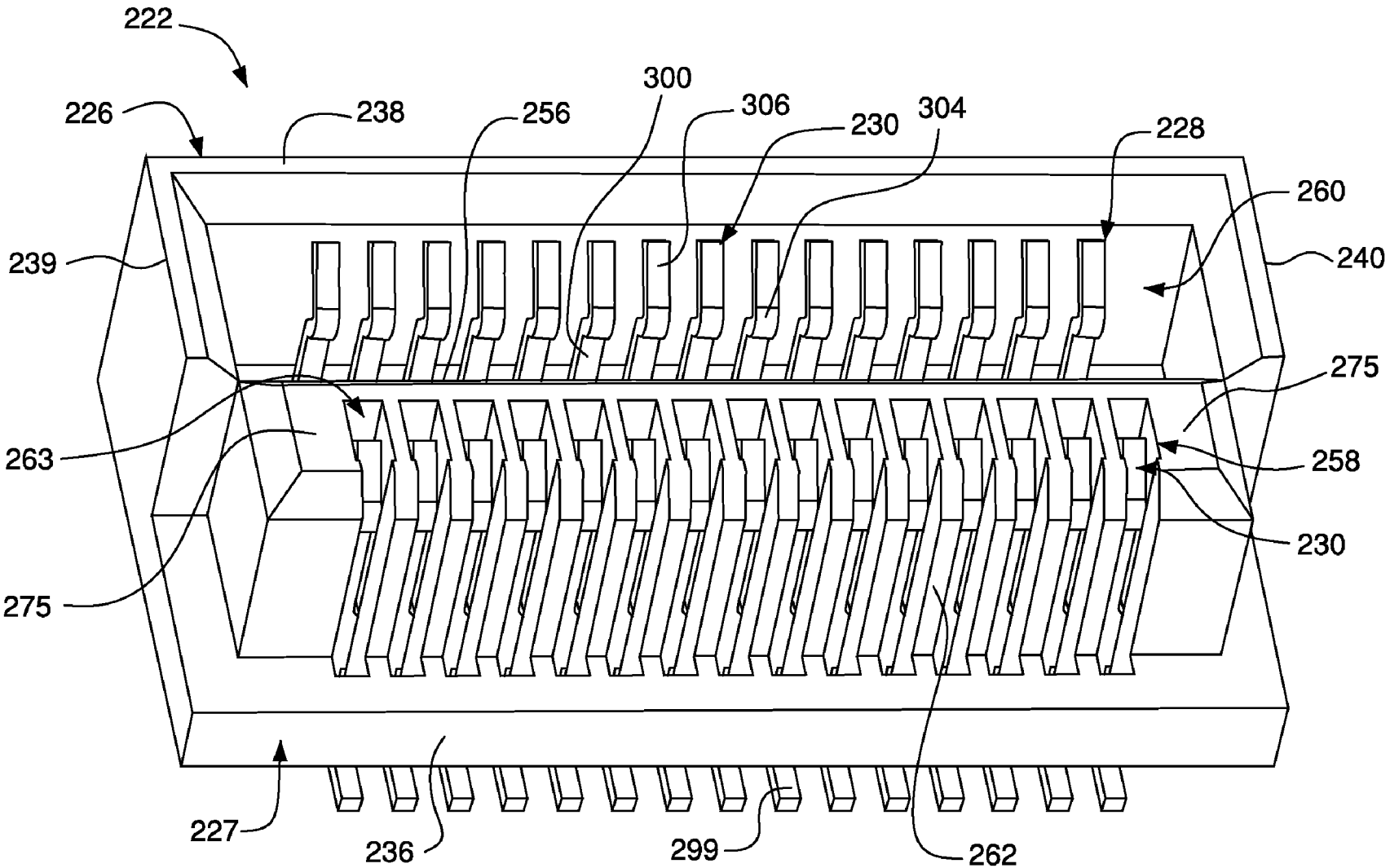
FIG. 26 is a perspective view of an electrical connector including the housing illustrated in FIG. 17 carrying a plurality of electrical contacts of the type illustrated in FIG. 24.
Figure 27:
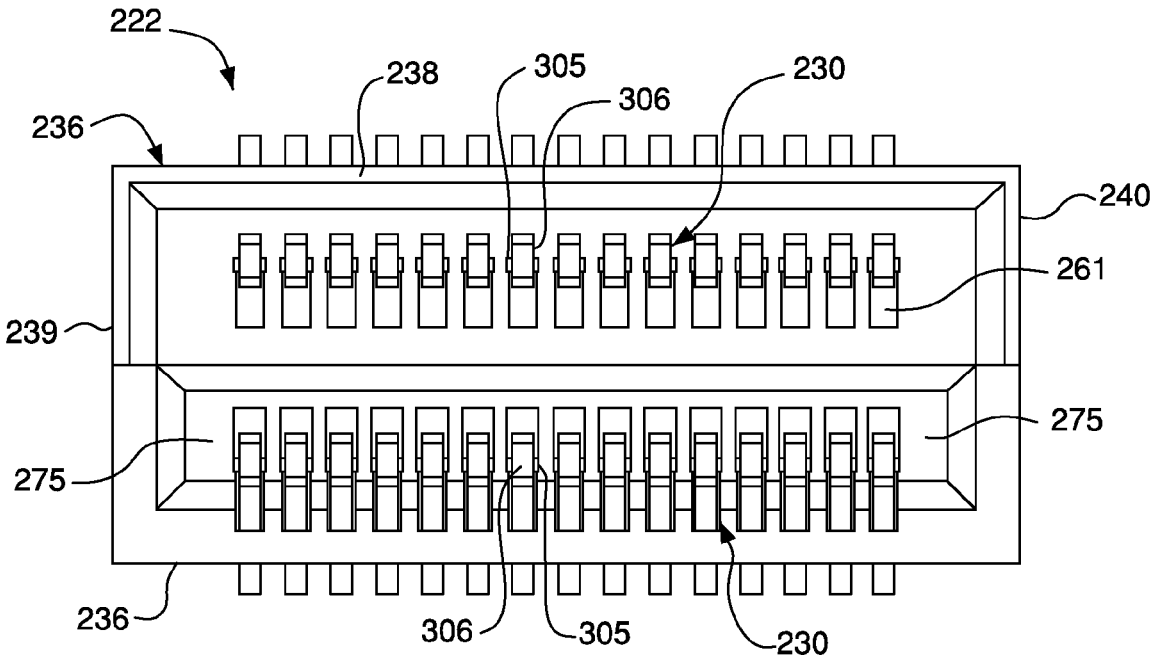
FIG. 27 is a top plan view of the electrical connector illustrated in FIG. 26.
Figure 28:
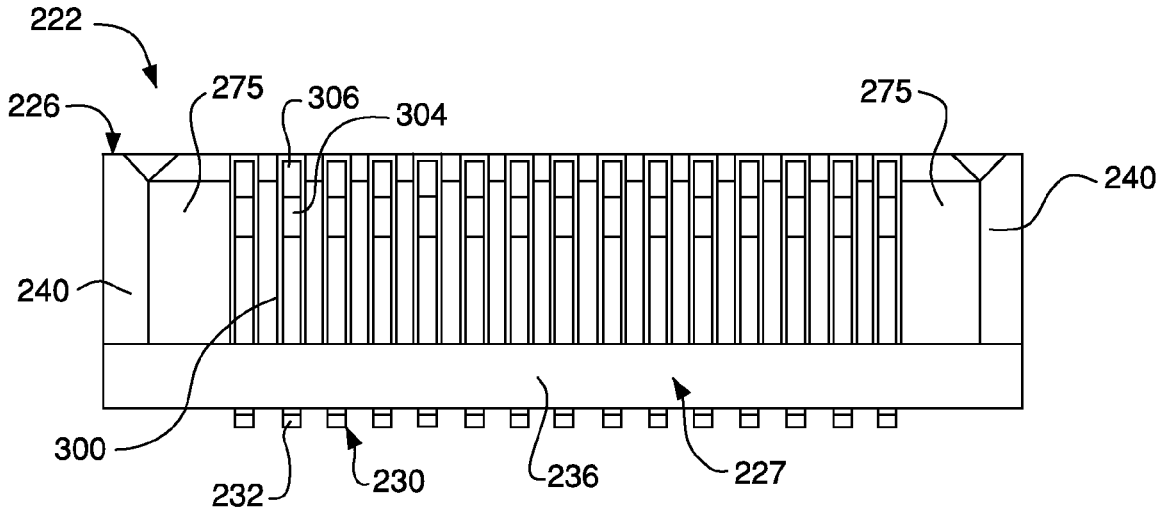
FIG. 28 is a front elevation view of the connector illustrated in FIG. 26.
Figure 29:
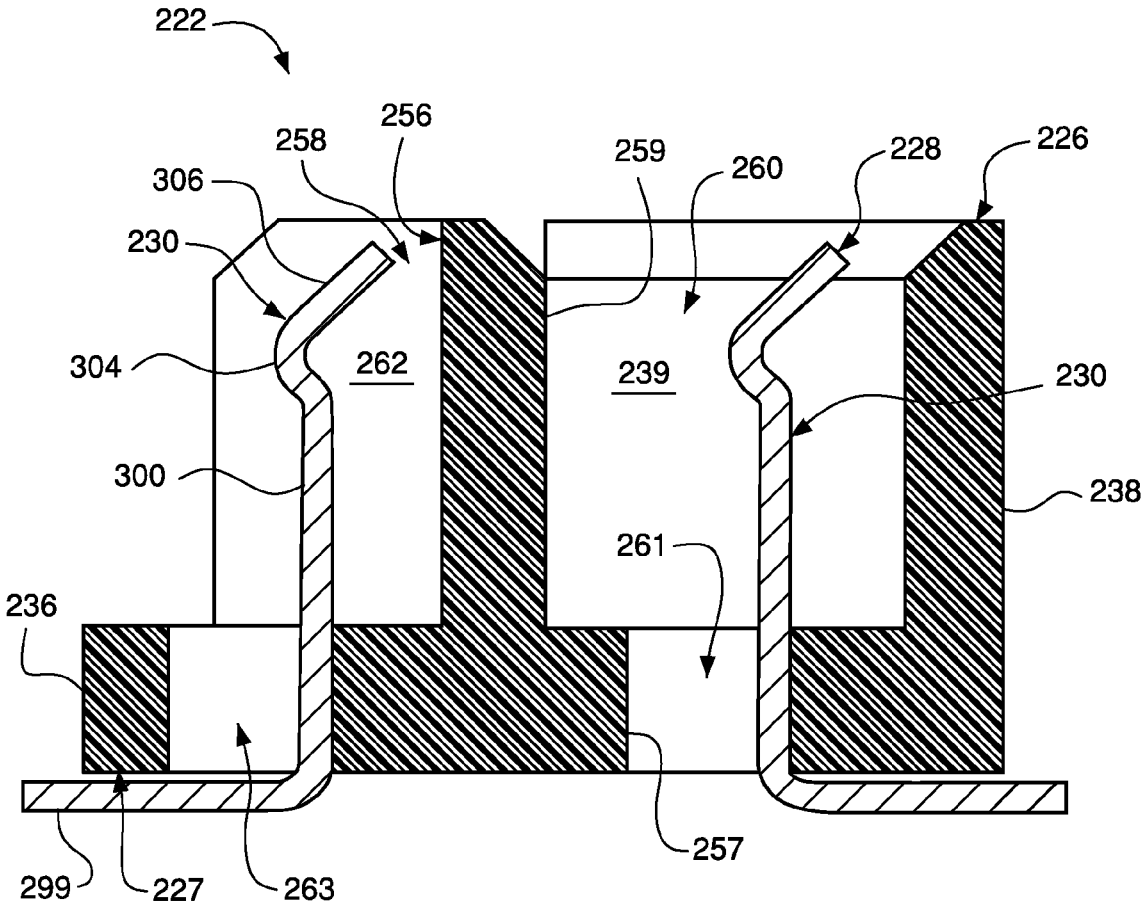
FIG. 29 is a sectional side elevation view similar to FIG. 24, but showing the electrical contacts installed in the housing.

Referring now to FIG. 25 in particular, the contact 230 can include a vertical stem 300 and a base 299 extending laterally outward from the lower end of the stem 300. A protrusion 305 extends from a lower portion of the stem 300 in both longitudinal directions when the contacts 230 are installed in the housing 226. The protrusion 305 can define a longitudinal dimension that is substantially equal to the areas of increased longitudinal dimension in the openings 261 and in the portion of the receptacles that extend through the base 227 such that each contact 230 of row 258 can be pressure fit in the corresponding receptacle 263 as shown in FIG. 27.

The upper end of the stem 300 can be connected to a jog 304 that juts out in a direction laterally offset with respect to the stem 300. When the electrical contact assembly 228 is installed in the housing 226, the jog juts out in a direction away from the side wall 238 and toward the side wall 236. The jogs 304 of both rows 258 and 260 of contacts 230 are offset in the same lateral direction. The upper end of the jogs 304 are connected to an angled cam portion 306 that extends up and out in a lateral direction opposite that of the jog 304, and defines a terminal end 308. The terminal end 308 can be laterally offset with respect to stem 300 in a direction toward the side wall 238 and away from the side wall 236 when the electrical contact assembly 228 is installed in the housing 226. In accordance with certain aspects of the present invention, the angled cam portion 306 can extend at an angle within a range of 25 and 60 degrees, including 45 degrees, with respect to the vertical stem 300.

It should be appreciated that unless otherwise specified, the electrical contacts 230 could alternatively assume any desirable geometric orientation that enables attachment to the electrical component 224 and also to the complementary contacts 230 of the other connector of the connector assembly 220 in a gender-neutral manner. It should be further appreciated that the number of electrically conductive contacts 230 of the contact assembly 228 can vary depending on the desired application.

In one aspect of the present invention, the contacts 230 can define a pitch within a range whose lower end can be defined by approximately 0.2 mm and whose upper end can be defined by approximately 0.5 mm. The pitch can be measured as the longitudinal distance between the centers of the upper ends of adjacent contacts 230 that are disposed in a given row.

The contacts 230 can be secured in the housing 226 in any known manner, and in one embodiment are stitched into the housing. An interference (not shown) can be provided between the contacts 230 and the housing to further secure the contacts 230 in place. Accordingly, once the contacts 230 are installed in the housing, the angled cam portions 306 of each contact 230 in the rows 258 and 260 are configured to engage the complementary contacts in rows 260 and 258, respectively, when the connector 222 mates with the opposing connector 222'.

Referring now to FIG. 30, the connector 222 can be attached to the electrical component 224, such as a printed circuit board, by attaching the base 299 of the electrical contacts 230 to corresponding electrical traces (not shown) of the component 224 in the manner described above with respect to connector 22, or in any suitable alternative manner.

The attachment of electrical connectors 222 and 222' will now be described with reference to FIGS. 31 and 32. It should be appreciated that the electrical components 224 are not shown as mounted to the connectors 222 and 222' in FIGS. 31 and 31, but that the connectors 222 and 222' could be pre-attached to the electrical components 224 if desired. In the description below, reference numerals of connector 222' that correspond to like elements of connector 222 are followed by an apostrophe (') for the purposes of clarity and convenience.

As illustrated in FIG. 31, the connectors 222 and 222' are generally aligned such that the rows 258 and 260 are aligned with the rows 260' and 258', respectively. In particular, the rows 258 and 258' are positioned to nest within rows 260' and 260. In this position, the spines 256 and 256' are offset with respect to each other such that the lateral edges of the spines 256 and 256' that face the corresponding side walls 238 and 238' are configured to slide along each other. Though not shown in FIGS. 31 and 32, the end walls 239 and 240 are aligned with the corresponding cutout portions 246', and the end walls 239' and 240' are aligned with the corresponding cutout portion 246.

As the connectors 222 and 222' are brought into contact with each other, the beveled upper ends of side walls 236 and 236' and beveled upper ends of the side walls 238' and 238' can assist in aligning the two connectors 222 and 222' for attachment. As the connectors 222 and 222' are brought into contact and further brought together, the angled cam portions 306 and 306' of each mating pair of contacts 230 and 230' ride along each other thus causing each mating pair of contacts 230 and 230' to flex laterally away from each other, which produces a counteracting lateral spring force that biases each mating pair of contacts 230 and 230' against each other. Because each connector 222 and 222' can be used interchangeably, the electrical connector assembly 220 can be referred to as including gender-neutral, or hermaphroditic, electrical contacts 230.

Referring to FIG. 32, as the connectors 222 and 222' are brought into a contact towards the illustrated fully seated configuration, the angled cam portions 306 and 306' of each mating pair of contacts 230 and 230' ride along each other thus causing each mating pair of contacts 230 and 230' to flex laterally away from each other, which produces a counteracting lateral spring force that biases each mating pair of contacts 230 and 230' against each other. Because the connectors 222 and 222' can mate interchangeably with each other, the electrical connector assembly 220 can be referred to as including gender-neutral, or hermaphroditic, electrical contacts 230.

When the connectors 222 and 222' are in an attached configuration, the jogs 304 and 304' of the each pair of mating contacts 230 and 230' slide past each other and engage the opposing stems 300' and 300, respectively. Because at least a portion of the jogs 304 and 304' overlap each other vertically, the biasing lateral spring force of the contacts 230 and 230' prevents the connectors 222 and 222' from becoming inadvertently detached. The connectors 222 and 222' can be detached by pulling the connectors apart with a force sufficient to overcome the resistance of the lateral spring force and allow the jogs 304 and 304' to slide past each other.

When the connectors 222 and 222' are in the fully seated configuration, the spines 256 and 256' slide past and abut each other until the upper ends of the spines 256 and 256' contact the complementary bases 227' and 227, respectively at a location between the spine and the corresponding sidewall 238' and 238, respectively. It should thus be appreciated that the spine 256 and 256' of each connector 222 and 222' are mating walls that each provide complementary engagement surfaces that engage each other at a location laterally between the rows of electrical contacts 230 and 230' so as to prevent or limit relative movement of the two connectors 222 and 222' with respect to a lateral direction. The spines 256 and 256' further engage each other at locations in longitudinal alignment with the rows of electrical contacts 230 and 230'.

The end walls 239 and 240, and side walls 238 of each connector also contact the base 227 of the opposing connector when the connectors 222 and 222' are in the fully seated position. Alternatively, one or more of the spine 256, side wall 238, and end walls 239 and 240 can have a height less than the remaining components of the engagement assembly 264, in which case the shortened components would not contact the base 227' of the complementary connector when the two connectors are in the fully seated configuration illustrated in FIG. 32.

In the fully seated configuration, the connector assembly 220 has a height only slightly greater than the height of the individual connectors 222 and 222' due to the clearance between the electrical contacts 230 and 230' and the upper ends of the side walls 238" and 238, respectively. In accordance with certain aspects of the present invention, the connector assembly 220 can have a height between 1% and 20%, or alternatively between 3% and 10%, greater than the height of one of the connectors 222 or 222' alone. For instance, the connector assembly 220 can have a height between approximately 5 mm and 8 mm, including approximately 5 mm, approximately 6 mm, approximately 7 mm, and approximately 8 mm. The height of the connector assembly 220 can also be variable as the connectors 222 and 222' can be attached at a fully unseated position illustrated in FIG. 14 whereby the lower ends of the jogs 304 and 304' are in contact, or at the fully seated position illustrated in FIG. 15, or anywhere between the unseated position and the fully seated position.

While the connector assembly 220 provides a "mezzanine" style connector (e.g., configured to connect the electrical components 224 in a parallel, but vertically spaced, relationship), the present invention recognizes that the connector assembly 220 can connect the electrical components 224 in alternative relationships without departing from the spirit and scope of the present invention.

The embodiments described in connection with the present invention have been presented by way of illustration, and the present invention is therefore not intended to be limited to the disclosed embodiments. Accordingly, those skilled in the art will realize that the invention is intended to encompass all modifications and alternative arrangements included within the spirit and scope of the invention, as set forth by the appended claims.

What is claimed:

1. An electrical connector assembly, comprising:

a first and second connector configured to be mated to each other, each connector including:

a housing extending along substantially perpendicular lateral and longitudinal directions, the housing defining an engagement tab that is longer in the lateral direction than in the longitudinal direction, the engagement tab presenting an engagement surface; and a plurality of electrical contacts secured in the housing and arranged in first and second longitudinally elongate rows, the first and second rows being spaced apart in the lateral direction and separated by a housing wall that is disposed between the first and second rows, the contacts defining first terminal ends extending from the housing and configured to connect with an electrical component, and gender-neutral second terminal ends extending from the housing to a height greater than that of the housing wall and less than that of the engagement tab, such that no part of the housing wall that is disposed between the first and second rows extends to a height greater than the height of the gender-neutral second terminal ends, and at least a respective portion the housing walls of the first and second connectors translate past each other as the first and second connectors are mated, wherein the housings of the connectors are configured to engage each other such that the second terminal ends of the each connector mate, and the engagement surfaces of each connector engage at a location between the rows of contacts so as to restrict relative lateral movement of the housings.

2. The electrical connector assembly as recited in claim 1, wherein the first row further comprises a plurality of dividers extending between the contacts so as to define slots interposed between adjacent dividers, the slots containing at least a portion of the contacts.

3. The electrical connector assembly as recited in claim 2, wherein the second row further comprises a plurality of dividers extending between the contacts so as to define slots interposed between adjacent dividers, the slots containing at least a portion of the contacts.

4. The electrical connector assembly as recited in claim 2, wherein the second row defines an opening that receives a plurality of electrical contacts.

5. The electrical connector assembly as recited in claim 1, wherein first and second rows of slots of the first electrical connector housing are aligned with the second and first rows, respectively, of slots of the second electrical connector housing when the connectors are mated.

6. The electrical connector assembly as recited in claim 1, wherein each housing defines a plurality of mating walls configured to slide past and engage each other when the connectors are mated.

7. The electrical connector assembly as recited in claim 6, wherein at least one of the mating walls of each housing has an upper surface configured to abut the opposing housing when the connectors are in a fully seated position.

8. The electrical connector assembly as recited in claim 1, wherein each connector housing includes a receptacle configured to receive the engagement surface of the other connector housing.

9. The electrical connector assembly as recited in claim 1, wherein the electrical contacts comprise jogs that interfere to resist detachment of the connector housings.

10. The electrical connector assembly as recited in claim 1, wherein the electrical contacts define a pitch of approximately 0.5 mm.

11. The electrical connector assembly as recited in claim 1, wherein the second terminal ends of the electrical contacts of each connector are configured to engage each other and cause each other to flex when the connectors are attached.

12. The electrical connector assembly as recited in claim 1, wherein the electrical contacts define a pitch of approximately 0.5 mm.

13. The electrical connector assembly as recited in claim 1, wherein the engagement surface comprises a laterally outermost surface of the engagement tab.

14. An electrical connector, comprising:

a housing extending along a longitudinal and a lateral direction, such that the housing is elongate along the longitudinal direction, the housing including a plurality of longitudinally spaced dividers, adjacent dividers defining receptacles therebetween; and a plurality of electrical contacts secured in the housing and arranged in first and second rows such that the electrical contacts of each row are spaced apart in the longitudinal direction, the electrical contacts defining first terminal ends supported by the housing and configured to connect with an electrical component, and gender-neutral second terminal ends extending from the housing and configured to connect with electrical contacts of a second housing, wherein the electrical contacts of the first row of electrical contacts are retained in respective receptacles defined between adjacent longitudinally spaced dividers and are movable in the respective receptacles, and electrical contacts of the second row of electrical contacts are not disposed between adjacent dividers, such that entireties of the gender-neutral second terminal ends of the electrical contacts of the second row of electrical contacts are disposed in a common space defined by the housing;

wherein the housing includes an engagement surface disposed at a location that is 1) laterally between the rows of contacts and 2) disposed entirely longitudinally outward of the first and second rows, the engagement surface configured to engage a corresponding engagement surface of the second housing so as to restrict relative movement between the housings.

15. The electrical connector as recited in claim 14, wherein at least one of the rows comprises a plurality of dividers and slots extending along the lateral direction, and at least a portion of the contacts is disposed in the slots.

16. The electrical connector as recited in claim 15, wherein the housing further comprises a receptacle configured to receive a complimentary surface of an opposing connector housing.

17. The electrical connector as recited in claim 14, wherein the engagement surface extends in a transverse direction perpendicular to the longitudinal and lateral directions and has a height greater than that of the electrical contacts.

18. The electrical connector as recited in claim 17, wherein the engagement surface extends to a height greater than the electrical contacts.

19. An electrical connector assembly, comprising:

a first and second connector configured to be mated to each other, each connector including:

a housing extending along substantially perpendicular lateral and longitudinal directions so as to define opposing longitudinally opposed outer ends and laterally opposed outer ends connected between the longitudinally opposed outer ends such that the longitudinally opposed outer ends and the laterally opposed outer ends define an outer perimeter of the housing, the housing defining an engagement tab disposed adjacent a select one of the laterally opposed outer ends, the engagement tab presenting an engagement surface;

a plurality of electrical contacts secured in the housing and arranged in first and second longitudinally elongate rows, the first and second rows being spaced apart in the lateral direction, the contacts defining first terminal ends extending from the housing and configured to connect with an electrical component, and gender-neutral second terminal ends extending from the housing; and a housing wall that is disposed between the first and second rows, such that at least a respective portion the housing walls of the first and second connectors translate past each other as the first and second connectors mate with each other, wherein the housings of the connectors are configured to mate with each other such that the second terminal ends of each connector mate, the engagement surfaces of each connector engage so as to restrict relative movement of the housings, and the engagement surface extends in a direction substantially perpendicular with respect to the longitudinal and lateral directions to a height greater than that of both the select outer end and the housing wall, and is fully contained at a location longitudinally between the rows of contacts and one of the longitudinally outer ends of the housing.

* * * * *

UNITED STATES PATENT AND TRADEMARK OFFICE

CERTIFICATE OF CORRECTION

PATENT NO. : 8,277,241 B2
APPLICATION NO. : 12/237756
DATED : October 2, 2012
INVENTOR(S) : Horchler et al.

It is certified that error appears in the above-identified patent and that said Letters Patent is hereby corrected as shown below:

Cover page, (57) ABSTRACT, first line, delete "The disclosure describes an" and substitute therefor --An--; delete "having" after "electrical connector assembly" and substitute therefor --includes-- so that the Abstract reads:

An electrical connector assembly includes first and second electrical connectors configured for mating. Each connector includes a housing that supports a plurality of electrical contacts. The contacts are arranged in first and second rows, and define a first terminal end extending from the housing and configured to connect with an electrical component, and a second hermaphroditic terminal end extending from the housing.

Signed and Sealed this
Twenty-seventh Day of November, 2012

David J. Kappos

David J. Kappos
*Director of the United States Patent and Trademark Office*